US012569100B2

(12) United States Patent
Moser et al.

(10) Patent No.: US 12,569,100 B2
(45) Date of Patent: Mar. 10, 2026

(54) CLEANING MACHINE HAVING JOINT DEVICE AND CLEANING MACHINE HAVING DRIVE DEVICE

(71) Applicant: Alfred Kärcher SE & Co. KG, Winnenden (DE)

(72) Inventors: Fabian Moser, Winnenden (DE); Michael Scharmacher, Winnenden (DE); Simon Kirschbaum, Winnenden (DE); Christoph Rufenach, Winnenden (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 158 days.

(21) Appl. No.: 17/501,763

(22) Filed: Oct. 14, 2021

(65) Prior Publication Data

US 2022/0031137 A1 Feb. 3, 2022

Related U.S. Application Data

(63) Continuation of application No. PCT/EP2020/059802, filed on Apr. 6, 2020.

(30) Foreign Application Priority Data

Apr. 15, 2019 (DE) ..... 10 2019 109 946.3

(51) Int. Cl.
*A47L 11/282* (2006.01)
*A47L 11/08* (2006.01)
(Continued)

(52) U.S. Cl.
CPC ..... *A47L 11/282* (2013.01); *A47L 11/08* (2013.01); *A47L 11/24* (2013.01);
(Continued)

(58) Field of Classification Search
CPC ..... A47L 11/10; A47L 11/14; A47L 11/18; A47L 11/28; A47L 11/282;
(Continued)

(56) References Cited

U.S. PATENT DOCUMENTS 3,750,223 A 8/1973 Leifheit
3,789,449 A 2/1974 MacFarland et al.
(Continued)

FOREIGN PATENT DOCUMENTS

CN 201 197 698 2/2009
CN 205901854 U * 1/2017 ..... H04M 1/12
(Continued)

OTHER PUBLICATIONS

English translation of EP1961518A1 (Year: 2008).*
(Continued)

*Primary Examiner* — David S Posigian
*Assistant Examiner* — Sukwoo James Chang
(74) *Attorney, Agent, or Firm* — Womble Bond Dickinson (US) LLP

(57) ABSTRACT

The invention relates to a cleaning machine, including a cleaning head, a holding rod device and a joint device by means of which the holding rod device is articulated to pivot on the cleaning head. Arranged on the holding rod device is a connection element that has a first region and a second region, wherein the second region is at a spacing from the first region in a transverse direction and the transverse direction is oriented transversely to a longitudinal axis of the holding rod device, wherein the connection element is connected by way of the second region to a joint of the joint device with which a pivot axis is associated, and wherein the connection element is connected by way of the first region to the holding rod device.

35 Claims, 18 Drawing Sheets

(51) Int. Cl.
*A47L 11/24* (2006.01)
*A47L 11/40* (2006.01)

(52) U.S. Cl.
CPC ..... *A47L 11/4016* (2013.01); *A47L 11/4041* (2013.01); *A47L 11/4069* (2013.01); *A47L 11/4075* (2013.01); *A47L 2201/04* (2013.01); *A47L 2201/06* (2013.01)

(58) Field of Classification Search
CPC ..... A47L 11/4041; A47L 11/4063; A47L 11/4066; A47L 11/4069; A47L 11/4075
See application file for complete search history.

(56) References Cited

U.S. PATENT DOCUMENTS

| | | | | |
|---|---|---|---|---|
| 4,875,246 | A | 10/1989 | MacGregor | |
| 6,026,529 | A | 2/2000 | Caruso | |
| 6,463,616 | B1 | 10/2002 | Morokutti | |
| 7,475,450 | B1 * | 1/2009 | Ragner | A47L 11/4069 15/384 |
| 9,289,105 | B2 | 3/2016 | Moes | |
| 9,826,874 | B2 | 11/2017 | Franke et al. | |
| 2008/0201877 | A1 | 8/2008 | Sengewald et al. | |
| 2014/0237754 | A1 * | 8/2014 | Conrad | A47L 9/00 15/328 |
| 2016/0278597 | A1 | 9/2016 | Braendle et al. | |
| 2017/0215676 | A1 | 8/2017 | Moser et al. | |
| 2017/0215677 | A1 | 8/2017 | Moser et al. | |
| 2017/0215678 | A1 | 8/2017 | Moser et al. | |
| 2017/0215679 | A1 | 8/2017 | Moser et al. | |
| 2017/0215681 | A1 | 8/2017 | Moser et al. | |
| 2018/0228331 | A1 | 8/2018 | Moser et al. | |
| 2019/0099052 | A1 | 4/2019 | Chung | |
| 2020/0170472 | A1 | 6/2020 | Meisenbacher et al. | |

FOREIGN PATENT DOCUMENTS

| | | | | |
|---|---|---|---|---|
| CN | 106998975 | A * | 8/2017 | A47L 5/30 |
| CN | 107007215 | | 8/2017 | |
| DE | 103 57 637 | | 7/2005 | |
| DE | 20 2013 012 345 | | 6/2016 | |
| DE | 202013012345 | U1 * | 6/2016 | A47L 11/33 |
| DE | 20 2018 104 772 | | 9/2018 | |
| EP | 1961518 | A1 * | 8/2008 | A47L 11/085 |
| EP | 3360457 | A1 * | 8/2018 | |
| EP | 3 461 386 | | 4/2019 | |
| EP | 3461386 | A1 * | 4/2019 | A47L 11/16 |
| GB | 146816 | | 11/1920 | |
| KR | 10-2009-0071509 | | 7/2009 | |
| KR | 20090071509 | A * | 7/2009 | A47L 11/4088 |
| WO | WO 2005/087075 | | 9/2005 | |

OTHER PUBLICATIONS

English translation of KR20090071509A (Year: 2009).*
English translation of DE202013012345U1 (Year: 2016).*
English translation of CN205901854U (Year: 2017).*
English translation of CN106998975A (Year: 2017).*

* cited by examiner

CLEANING MACHINE HAVING JOINT DEVICE AND CLEANING MACHINE HAVING DRIVE DEVICE

CROSS REFERENCE TO RELATED APPLICATIONS

This application is a continuation of international application number PCT/EP2020/059802 filed on Apr. 6, 2020, which claims the benefit of German patent application number 10 2019 109 946.3 filed on Apr. 15, 2019, which are incorporated herein by reference in their entirety and for all purposes.

BACKGROUND OF THE INVENTION

The invention relates to a cleaning machine, comprising a cleaning head, a holding rod device and a joint device by means of which the holding rod device is articulated to pivot on the cleaning head.

Further, the invention relates to a cleaning machine, comprising a cleaning head, a first roller unit, a second roller unit and a drive device for driving the first roller unit and the second roller unit in rotation.

GB 146,816 discloses a portable vacuum cleaner with a handle arrangement.

US 2019/0099052 A1 discloses a rotary mop cleaner.

EP 0 950 370 A2 discloses a drive system for two cylindrical brushes that rotate in opposite directions.

DE 10 2013 215 198 A1 discloses a manually guided soil cultivation device.

DE 20 2013 012 345 U1 discloses a sweeping machine.

DE 103 57 637 A1 discloses a sweeper device that is self-propelling or is to be rolled.

DE 21 02 325 A discloses a device for generating and applying cleaning foam.

WO 2016/058901 A1, WO 2016/058856 A1, WO 2017/063663 A1, WO 2016/058879 A1 and WO 2016/058956 A1 disclose surface cleaning machines. WO 2016/058907 A1 likewise discloses a surface cleaning machine.

U.S. Pat. No. 4,875,246 discloses a portable floor cleaning device that has a roller driven by an electric motor.

DE 20 2009 013 434 U1 discloses a device for the wet cleaning of a floor using a brush that is rotatable about an axis of rotation.

CN 201 197 698 Y discloses a cleaning machine.

U.S. Pat. No. 6,026,529 discloses a device for cleaning floors or other hard surfaces.

WO 2005/087075 A1 discloses a floor cleaning machine having a handle that is arranged to pivot on a base.

WO 2015/086083 A1 discloses a further floor cleaning machine.

U.S. Pat. No. 3,789,449 discloses a hard floor cleaning device.

CN 107007215 A discloses a floor cleaning robot.

DE 20 2018 104 772 U1 discloses a dirty water collecting mechanism and dirty water detection mechanism and a cleaning device.

In accordance with an embodiment of the invention, a cleaning machine of the type mentioned in the introduction is provided that is operable in a simple manner by means of the joint device.

SUMMARY OF THE INVENTION

In accordance with an embodiment of the invention, provision is made that arranged on the holding rod device is a connection element that has a first region and a second region, wherein the second region is at a spacing from the first region in a transverse direction and the transverse direction is oriented transversely to a longitudinal axis of the holding rod device, in that the connection element is connected by way of the second region to a joint of the joint device with which a pivot axis is associated, wherein in particular the joint is a first joint of the joint device, with a first pivot axis, and in that the connection element is connected by way of the first region to the holding rod device.

By articulating the holding rod device to the cleaning head by way of the connection element, it is a simple matter to produce a cleaning machine in which, in particular by steering on the holding rod device, a cleaning head is steerable on a surface to be cleaned.

As a result of the connection element, a height of the cleaning head between an underside and an upper side can be kept small. This results in a good capacity for reaching under furniture and similar.

By way of the connection element, it is a simple matter to produce a fixing device in order to fix the holding rod device in an oriented position and in particular an upright position relative to the cleaning head.

By way of the connection element, it is possible to form a joint device that is producible in a structurally simple and space-saving manner. In particular, it is possible to provide a joint device that has (at least) a first joint and a second joint. This results in optimised operability.

As a result of the fact that the first region is offset in the transverse direction relative to the second region, the joint device can be used to shift the holding rod device such that the cleaning machine has a small height in this shifted position ("second position" of the holding rod device in relation to the cleaning head). Moreover, there is then in particular no need to provide a recess on the cleaning head for receiving the holding rod device. As a result of this, the cleaning head can take a form optimised for the cleaning task.

In particular, the connection element takes the form of an angled element or curved element. As a result, it is a simple matter to achieve a spacing between the first region, which is fixed to the holding rod device, and the second region, which is fixed to the joint.

In one embodiment, the second region is arranged at an angle to the first region, wherein the angle is in particular an obtuse angle. In this case, the angle refers to enveloping planes of the first region and the second region; the enveloping planes are at the said angle. In the case of a curved element, the enveloping planes may for example be tangential planes on the first region and the second region respectively. An obtuse angle results in a space-saving construction. It is also possible to provide a transverse web between the first region and the second region. This enables the first region to be offset from the second region.

In particular, the first region of the connection element is oriented coaxially relative to the longitudinal axis of the holding rod device. This produces a structurally simple composition of the cleaning machine.

It is favourable if there is arranged on the cleaning head at least one cleaning tool, having at least one of the following:

- the pivot axis of the joint is oriented at least approximately parallel to a planar surface on which the cleaning head is supported by the at least one cleaning tool, for a correct cleaning operation;

the pivot axis is oriented at least approximately parallel to an enveloping plane of the at least one cleaning tool, in respect of contact with a surface to be cleaned;

the pivot axis is oriented at least approximately parallel to an axis of rotation of the at least one cleaning tool;

the pivot axis is oriented at least approximately parallel to a width direction of the cleaning head between a first lateral side and a second lateral side;

the pivot axis is oriented transversely, in particular perpendicularly, to a straight-ahead direction of travel of the cleaning head during a correct cleaning operation;

the pivot axis lies within the cleaning head and, in particular relative to a height direction between an underside of the cleaning head and an upper side of the cleaning head, lies between the underside of the cleaning head and the upper side of the cleaning head;

the cleaning head has a front end and a rear end, wherein it extends in a longitudinal direction between the front end and the rear end, and the pivot axis lies transversely and in particular perpendicularly to the longitudinal direction of the cleaning head;

the joint and/or the pivot axis lie between the front end and the rear end of the cleaning head, and lie, in particular relative to the longitudinal direction of the cleaning head, at a centre between the front end and the rear end or closer to the centre than to the front end and to the rear end;

the joint and/or the pivot axis lie, relative to the longitudinal direction of the cleaning head, closer to the rear end than to the front end.

The pivot axis is for example a first pivot axis by way of which a size adjustment may be made to a height of a user who is standing upright on the surface to be cleaned. This allows a cleaning movement to be performed with the appropriate adjustability.

It is favourable if the connection element has a jaw-like opening that faces a rear end of the cleaning head. In particular, at the jaw-like opening the connection element takes a concave form relative to an osculating curve.

It is quite particularly advantageous if there is arranged or formed in the cleaning head a recess in which the joint is positioned, wherein in particular the second region penetrates into the recess, at least with part of this region. In this way, a type of countersunk joint can be produced. As a result, the height of the cleaning head can be kept small. This results in optimised utilisation of space.

It is favourable if the pivot axis lies in or below the recess. This results in a compact construction of the cleaning head. The term "below the recess" here means that, in a height direction between an underside and an upper side of the cleaning head, the pivot axis lies lower than the recess in respect of this height direction.

It is quite particularly advantageous if, in relation to the pivot axis, the holding rod device has an (extreme) first position with at least one of the following:

the holding rod device is positioned, in relation to a longitudinal direction of the holding rod device, transversely to the cleaning head, wherein an angle between the longitudinal direction of the holding rod device and the cleaning head is in particular in the range between 75° and 105° and is for example at least approximately 90°;

the first region of the connection element is positioned transversely to the cleaning head, wherein in particular an angle between the first region and the cleaning head is in the range between 75° and 105° and is for example at least approximately 90°;

the cleaning machine has its greatest height in a height direction between an underside of the cleaning head and an upper side of the cleaning head;

the second region of the connection element is positioned transversely to the cleaning head;

the second region of the connection element is oriented at an obtuse angle to the cleaning head, relative to a jaw-like opening of the connection element between the first region and the second region;

the obtuse angle of the orientation of the second region to the cleaning head corresponds to the difference between 270° and an obtuse angle between the first region and the second region.

The first position is a type of parked position of the holding rod device in relation to the cleaning head. In the height direction (which runs between the underside of the cleaning head and the upper side of the cleaning head) the cleaning machine then has in particular its greatest dimensions.

It is favourable if a fixing device is provided for the purpose of fixing the first position with force locking. This results in a parked position in which the holding rod device is held in the first position. As a result of force-locking fixing, the fixing device takes a simple form and is simple for a user to operate.

In particular, the fixing device takes a form such that, if the cleaning head is set on a subsurface that is inclined by 10° to the horizontal in relation to the direction of gravity, the first position is maintained. If the cleaning head is accordingly set on an inclined subsurface, in principle the holding rod device can "fall" out of the first position as a result of its own weight. The fixing device is accordingly dimensioned such that, with an inclination of 10° (or more), there is no automatic "falling" out of the first position in this way. It has been found that an appropriate force required to move the holding rod device out of the first position even if the cleaning head is set on a planar subsurface is easy for a user to exert, while otherwise the first position is sufficiently secured.

In one embodiment, the fixing device has a first element, which is arranged or formed in the cleaning head, and a second element, which is arranged or formed on the connection element, wherein the first element and the second element cooperate for the purpose of the force-locking fixing in the first position. In this way, a fixing device can be produced in a structurally simple and space-saving manner.

In one embodiment, the second element is arranged or formed on the second region of the connection element. This produces a compact and space-saving construction of the surface cleaning machine.

For example, the fixing device has a magnet device. It is thus a simple matter to produce a force-locking fixing by way of magnetic retaining forces.

It is favourable if the first element is a magnet or comprises a magnet that is arranged on the cleaning head, and the second element is a retaining element for the magnet, wherein in particular the connection element takes the form of a retaining element. In this way, a fixing device can be produced in a structurally simple manner. There is no need to provide positive locking or similar. The fixing device is easy for the user to operate.

It has been found favourable if the magnet is part of a sandwich-type magnet system. For example, the magnet, as the magnetic plate, is positioned between two flat iron poles. These can take up the magnetic flux of the magnet and produce high retaining forces.

It is favourable if at least one cleaning tool is arranged on the cleaning head, the holding rod device has, relative to the pivot axis, a second position, and having at least one of the following:

- in relation to a longitudinal axis of the holding rod device, the holding rod device and/or the first region of the connection element is oriented at least approximately parallel to an enveloping plane of the at least one cleaning tool;
- the cleaning machine has its minimal height in a height direction between an underside of the cleaning head and an upper side of the cleaning head;
- a region of the holding rod device faces the at least one cleaning head and lies in particular below the upper side of the cleaning head;
- in relation to a jaw-like opening of the connection element between the first region and the second region, the second region of the connection element is oriented at an angle of zero or an acute angle to the cleaning head;
- the acute angle of the orientation of the second region to the cleaning head corresponds to a difference between 180° and the obtuse angle between the first region and the second region of the connection element;
- the holding rod device does not project, or projects by at most 5 cm, above an upper side of the cleaning head.

In the second position of the holding rod device in relation to the cleaning head, in particular the cleaning machine has a minimal height in the corresponding height direction. This results in a good capacity for reaching under furniture and similar.

It is favourable if the holding rod device is pivotal about the pivot axis between a first position and a second position, wherein in particular a pivotal region between the first position and the second position is in the range between 80° and 100° and is for example at least approximately 90°. This results in optimised operability. On the one hand, it results for example in adjustability to a height of a user. On the other, it results in a good capacity for reaching under furniture and similar.

It is quite particularly advantageous if the joint device is arranged and takes a form such that, by steering the holding rod device, the cleaning head is steered on a surface that is to be cleaned. In particular, the cleaning head is supported on the surface to be cleaned by way of at least two cleaning roller units. This results in simple operation. For example, a movement of the cleaning head on a surface to be cleaned may be driven.

In particular, the joint device has the joint, as the first joint having a first pivot axis, and has a second joint having a second pivot axis, wherein the second pivot axis is oriented transversely to the first pivot axis. If for example the first pivot axis is oriented parallel to an enveloping plane of the at least one cleaning tool, then this may be used among other things to allow a user to make a height adjustment. Steering may be achieved in a simple manner by way of the second pivot axis.

It is quite particularly advantageous if the second pivot axis intersects the first pivot axis or is at a spacing of at most 2 cm and in particular at most 1 cm therefrom. This allows steering of the cleaning head on a surface that is to be cleaned to be achieved by steering the holding rod device.

For the same reason, it is favourable if the second pivot axis passes through the second region of the connection element. This enables the joint device to be produced simply and with a space-saving construction.

It is for example provided for a joint element of the second joint to be arranged at the second region of the connection element and to enable pivotability about the second pivot axis, and in particular for a joint part of the first joint to be arranged at the second region and to enable pivotability about the first pivot axis, wherein in particular the joint parts of the first joint and the second joint are produced as a single part or are at a spacing of at most 5 cm from one another. This makes it possible for the first pivot axis and the second pivot axis to intersect or to have only a small spacing of at most 2 cm. The corresponding joint device can take a space-saving form and be positioned at a cleaning head in a corresponding space-saving manner.

In the case of a cleaning machine comprising a cleaning head, a holding rod device and a joint device by means of which the holding rod device is articulated to pivot on the cleaning head, the object mentioned in the introduction is further achieved by at least one of the following:

- in relation to a longitudinal axis of the cleaning head, the joint device is positioned between a first cleaning tool and a second cleaning tool, wherein the cleaning tools in particular take the form of cleaning rollers;
- in relation to a height direction of the cleaning head, between an underside of the cleaning head and an upper side of the cleaning head, the joint device is positioned above a reservoir device for dirty fluid;
- in relation to a height direction of the cleaning head, between an underside of the cleaning head and an upper side of the cleaning head, the joint device is positioned above a drive device;
- associated with the drive device is a free space in which the joint device is at least in part positioned.

This allows the joint device to take a form that is structurally simple and space-saving. This can be positioned on the cleaning head in a space-saving manner. As a result, the cleaning head itself can be formed with a small height. This makes it easy for a user to operate.

In one embodiment, associated with the joint device is a casing that is positioned in particular on the cleaning head and the holding rod device. This allows the joint device to be sealed such that it is fluid-tight.

A further object of the invention is to provide a cleaning machine of the type mentioned in the introduction in which the cleaning head is configurable with minimised height.

This object is achieved in the case of the cleaning machine mentioned in the introduction, or otherwise, in that the drive device has a drive motor that, in relation to a longitudinal direction of the cleaning head, is positioned between the first roller unit and the second roller unit, in that the drive device comprises a gear device through which torque of the drive motor is transmissible to the first roller unit and the second roller unit, and in that the gear device comprises a step-down gear, wherein a speed of rotation of the first roller unit and a speed of rotation of the second roller unit are less than a motor speed of the drive motor.

By using a drive motor of relatively high speed, which may typically be 6 400 revolutions per minute, this drive motor may have small geometric dimensions. The torque may be transmitted to the roller units by way of the gear device with the step-down gear, and this enables revolution of the roller units at lower speed, as such typically 500 revolutions per minute.

As a result, the cleaning head can have a small space requirement. In particular, it can be produced with a smaller height between an underside and an upper side. This results in a good capacity for reaching under objects.

Further, the drive device makes it possible for the roller units to take a form such that they make it possible to clean close to edges on lateral sides. It is also easy to clean close to edges at a front end and a rear end. As a result of the gear device, in particular a centre link can easily be achieved.

It is favourable if the step-down gear has a step-down ratio, of speed of the drive motor to roller speed, in the range between 1:10 and 1:15 and in particular at least approximately 1:12.5, wherein in particular a roller speed is in the range between 400 revolutions per minute and 600 revolutions per minute. This allows a drive motor of relatively high speed and small geometric dimensions to be used.

In one embodiment, the gear device takes a form such that the first roller unit and the second roller unit rotate in opposite directions. This results in an optimised cleaning result. For example, a particular surface region over which the first roller unit and the second roller unit pass successively can be "double cleaned".

It is favourable if the step-down gear is formed to have multiple stages and in particular is formed to have three stages. This results in a space-saving construction.

In one embodiment, the gear device has a pinion arrangement, which acts as a two-stage step-down gear, and a belt arrangement, which acts as a one-stage step-down gear, wherein the belt arrangement is coupled to the pinion arrangement in a manner applying torque. This produces a space-saving construction of the gear device. Torque can easily be transmitted over a length region by way of the belt arrangement. The gear device can in this way be positioned in the cleaning head in a space-saving manner.

In particular, the belt arrangement (as in the case of the first part and a second part) is coupled to a respective shaft of each roller unit in a manner applying torque. In this way, the torque can be transmitted to the roller units at a spacing from the drive motor. As a result, it is possible for example to clean close (in respect of the roller units) to edges at a front end and a rear end of the cleaning head. Further, a centre link for transmitting the torque of the drive motor to the roller units can easily be achieved by way of the belt arrangement. By way of the drive motor, both the first roller unit and also the second roller unit can be driven in a rotary movement.

In one embodiment, the pinion arrangement has a first gearwheel-and-pinion combined unit coupled to the drive motor, and a second gearwheel-and-pinion combined unit coupled to the first gearwheel-and-pinion combined unit and to the belt arrangement. This makes it an easy matter to produce a two-stage step-down gear. Further, the first roller unit and the second roller unit can easily be driven.

In particular, for driving the first roller unit and the second roller unit, also provided is a third pinion-and-gearwheel combined unit coupled to the second pinion-and-gearwheel combined unit and to the belt arrangement. This makes it an easy matter to produce rotation of the roller units in opposite directions.

In one embodiment, the second pinion-and-gearwheel combined unit is coupled to a first part of the belt arrangement, which is coupled to the first roller unit, and the third pinion-and-gearwheel combined unit is coupled to a second part of the belt arrangement, which is coupled to the second roller unit. In this way, the torque of the drive motor can be transmitted to both the first roller unit and the second roller unit. These can then be positioned at a spacing from one another. In particular, this allows the cleaning head to be supported on a surface to be cleaned only by way of the first roller unit and the second roller unit. There is no need to provide support rollers or similar, which may leave tracks on a surface that is to be cleaned. Further, it allows cleaning close to edges to be achieved in a simple manner, both in respect of a front end and a rear end and also in respect of lateral sides.

Advantageously, at least one of the following is provided:

- a drive axis of the drive motor is oriented parallel to at least one axis of rotation of the roller units;
- a drive axis of the drive motor is oriented parallel to the pivot axis (first pivot axis) of the joint device;
- the drive axis of the drive motor and the pivot axis (first pivot axis) are at a spacing of at most 5 cm from one another.

In this way, the cleaning head can take a compact form, with a relatively small height and hence a good capacity for reaching under objects.

In one embodiment, arranged on the cleaning head are a first roller unit and a second roller unit that are each formed in two parts, wherein a drive device is coupled centrally to the respective roller units in a manner applying torque. In this way, a centre drive of the roller units can be achieved. As a result, there is no need to provide, close to edges, a suspension or drive or mounting for the roller units. These may reach as far as lateral sides of the cleaning head. The result is that it is possible to clean laterally close to edges.

It is favourable if the roller units reach as far as an end face of the cleaning head. This allows lateral cleaning close to edges.

In one embodiment, a first roller unit and a second roller unit are provided, wherein the first roller unit and/or the second roller unit take the form of cleaning rollers and in particular have a textile facing. In principle, it is also possible for the first roller unit and the second roller unit to take the form of sweeping rollers and to be provided for example with brushes. For example, it is also possible for a roller unit to be provided with a textile facing and to take the form of a scrubbing roller, and for the second roller unit to take the form of sweeping rollers.

It is favourable if, in a height direction between an underside of the cleaning head and an upper side of the cleaning head, the cleaning head has a height of at most 20 cm, or at most 15 cm, or at most 14 cm, or at most 13 cm, or at most 12 cm, or at most 11 cm. This results in a good capacity for reaching under objects, and it is possible to reach under furniture and similar.

In principle, with the drive device (and without the holding rod device) the cleaning machine may take the form of a self-propelling and self-steering device. It has a low overall height.

As an alternative, it is possible for the cleaning machine to take the form of a manually guided surface cleaning machine, in particular for floor surfaces and hard floor surfaces.

The description below of preferred embodiments serves, in conjunction with the drawings, to explain the invention in more detail.

DETAILED DESCRIPTION OF THE INVENTION

Figure 1:
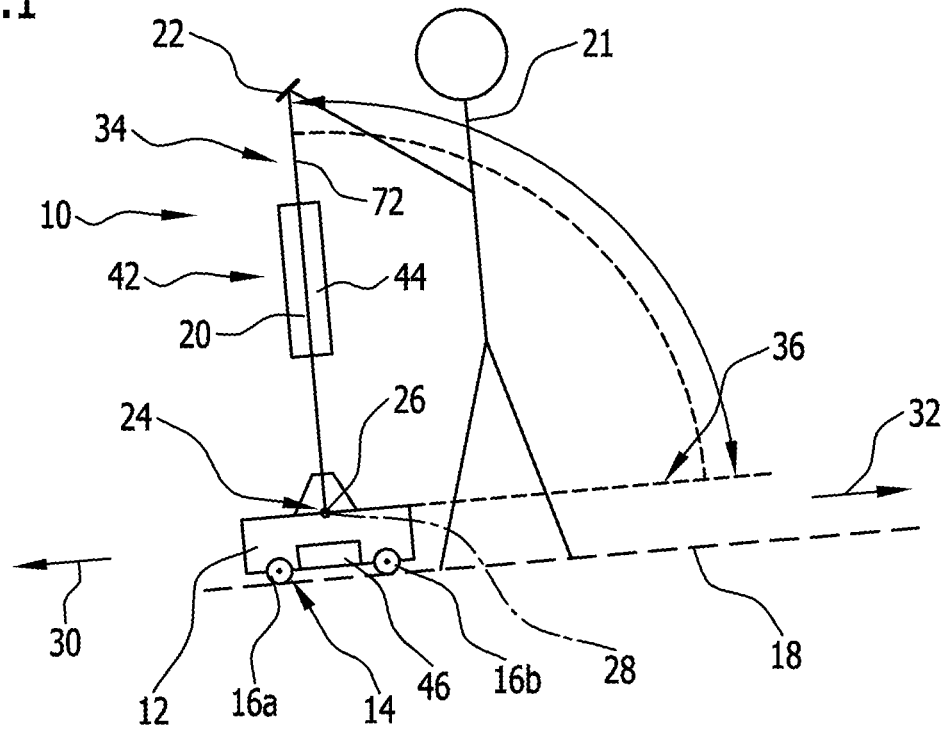
FIG. 1 is a schematic representation of an exemplary embodiment of a cleaning machine having a joint device, wherein the fact that a holding rod device is pivotal about a first pivot axis (which lies perpendicularly to the plane of the drawing) is shown.
Figure 2:
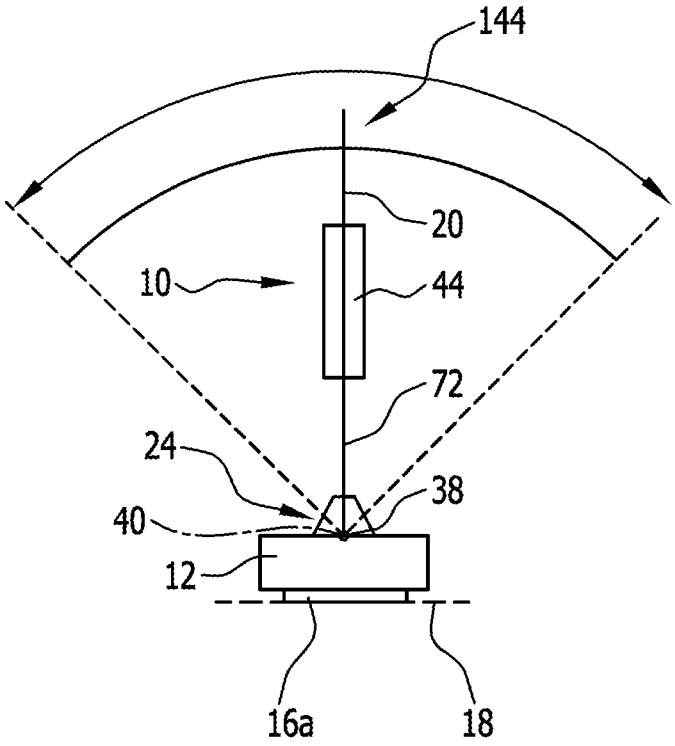
FIG. 2 shows the cleaning machine according to FIG. 1, wherein the fact that the holding rod device is pivotal about a second pivot axis is shown.

An exemplary embodiment of a cleaning machine, which is shown schematically in FIGS. 1 and 2 and is designated 10, is a surface cleaning machine that is used for cleaning surfaces and in particular floors, and in this context in particular hard floors.

The cleaning machine 10 comprises a cleaning head 12. Arranged on the cleaning head 12 is a (at least one) cleaning tool 14.

In the exemplary embodiment shown, there are used as cleaning tools a first cleaning roller unit 16*a* and a second cleaning roller unit 16*b*. The first cleaning roller unit 16*a* and the second cleaning roller unit 16*b* are at a spacing from one another. During operation of the cleaning machine 10, the cleaning head 12 and at the same time the entire cleaning machine 10 are supported on a surface 18 that is to be cleaned by way of the cleaning roller units 16*a*, 16*b*.

The cleaning machine 10 is manually guided. Arranged on the cleaning head 12 is a holding rod device 20. A user 21 can hold the cleaning machine 10 by a handle 22 that is seated on the holding rod device 20.

The dimensions of the cleaning machine 10 are such that when cleaning roller units 16*a*, 16*b* is supported on the surface 18 that is to be cleaned the user 21 can comfortably carry out the cleaning procedure on the surface 18 to be cleaned with one, bent holding arm. In particular, a length of the cleaning machine 10 along a longitudinal axis between the cleaning roller units 16*a*, 16*b* and the handle 22 is in the range between 60 cm and 130 cm. In particular, operating elements and display elements are arranged on the handle 22.

The holding rod device 20 is articulated to the cleaning head 12 by way of a joint device 24. The joint device 24 enables pivotability of the holding rod device 20 in relation to the cleaning head 12.

In one embodiment, the joint device 24 comprises a first joint 26 with a first pivot axis 28. In FIG. 1, pivotability about the first pivot axis 28 is indicated. In the schematic representation in FIG. 1, the first pivot axis 28 is perpendicular to the plane of the drawing.

As a result of pivoting about the first pivot axis 28, a height position of the handle 22 is adjustable in relation to the surface 18 to be cleaned, on which the cleaning head 12 is set by way of the cleaning roller units 16*a*, 16*b*. As a result, among other things it is possible to adjust the size to the user 21 and, during a cleaning operation, movements made by the user can be "balanced out".

The cleaning machine 10 has a straight-ahead direction of travel 30.

In particular, the cleaning roller units 16*a*, 16*b* are driven in a rotary movement. The straight-ahead direction of travel 30 is in particular determined by a direction of rotation of the cleaning roller units 16*a*, 16*b*.

Further, there is associated with the cleaning machine 10 a straight-back direction of travel 32 that is opposite to the straight-ahead direction of travel 30.

The directions 30 and/or 32 may be directions in which the cleaning machine 10 moves automatically, or they may correspond to push directions that have to be instigated by a user.

Here, the joint device 24 with the first joint 26, which is pivotal about the first pivot axis 28, in particular takes a form such that the holding rod device 20 is pivotal between a first position 34 and a second position indicated by the reference numeral 36. A pivotal range between the first position 34 and the second position 36 is in particular in the range between 75° and 105°. In a concrete exemplary embodiment (cf. FIG. 1), the pivotal range between the first position 34 and the second position 36 is 90°.

In the second position 36, in particular the holding rod device 20 points with the handle 22 in the direction of the straight-back direction of travel 32.

In the first position 34, in particular the holding rod device 20 is oriented at least approximately perpendicularly to the cleaning head 12.

Further, the joint device 24 comprises a second joint 38 (FIG. 2) having a second pivot axis 40. The holding rod device 20 is pivotal about the second pivot axis 40 by way of the second joint 38. The second pivot axis 40 is oriented transversely to the first pivot axis 28.

In one exemplary embodiment, the second joint 38 is pivotal by way of the first joint 26, such that the second pivot axis 40 is not an axis that is fixed in space.

By way of the second joint 38 with pivotability about the second pivot axis 40, it is possible to achieve transverse pivoting (cf. FIG. 2) in relation to a user who is standing behind the cleaning head 12, on the surface 18 to be cleaned.

A pivotal range in relation to a home position is for example +/−45°.

In particular, the joint device 24 takes a form such that a user 21 can steer the cleaning head 12 on the surface 18 to be cleaned by steering on the holding rod device 20. The cleaning head 12 follows a steering movement of the holding rod device 20 that is instigated by the user 21.

In one exemplary embodiment, there is provided a wetting device 42 by way of which the cleaning roller units 16*a*, 16*b* with a cleaning liquid (which may be clean water, or clean water mixed with a cleaning agent). The wetting device 42 comprises a reservoir device 44 for cleaning liquid. The reservoir device 44 for cleaning liquid is arranged in particular on the holding rod device 20. A supply device is provided, by way of which cleaning liquid is suppliable to the cleaning head 12.

A reservoir device 46 for dirty fluid is provided, and this receives dirty fluid. In this case, this reservoir device 46 for dirty fluid may be arranged on the holding rod device 20. In the exemplary embodiment shown in FIGS. 1 and 2, the reservoir device 46 for dirty fluid is seated on the cleaning head 12, between the first cleaning roller unit 16*a* and the second cleaning roller unit 16*b*.

In one exemplary embodiment, it is provided for dirty fluid to be removed by suction and in particular in this context to be removed from the cleaning roller units 16*a*, 16*b* by suction and conveyed into the reservoir device 46 for dirty fluid.

For example, it is also possible for dirty fluid to be drawn off the cleaning roller units 16*a*, 16*b* and as it were spun off into the reservoir device 46 for dirty fluid without the provision of a suction flow acting on the cleaning roller units 16*a*, 16*b*.

One exemplary embodiment of a cleaning machine according to the invention is a surface cleaning machine 50 (FIGS. 3 to 10). The surface cleaning machine 10 serves in particular to clean hard floors.

The basic configuration with holding rod device and cleaning head is described above in a manner relating to the cleaning machine 10.

The cleaning machine 50 comprises a cleaning head 52. This is shown in a partial representation in FIG. 3.

The cleaning head 52 has a head body 54. Arranged on the head body 54 is a first shaft 56. The first shaft 56 is mounted rotatably about a first axis of rotation 58. Seated on the first shaft 56 is a first cleaning roller unit 60, as a first cleaning tool.

At a spacing from the first shaft 56, a second shaft 62 is mounted on the head body 54, rotatably about a second axis of rotation 64. Seated on the second shaft 62 is a second cleaning roller unit 66, as a second cleaning tool. The first cleaning roller unit 60 and the second cleaning roller unit 66 each have a cylindrical bushing 68 on which a cleaning medium 70 is seated.

In one exemplary embodiment, the cleaning medium 70 is a textile material such as a microfibre material.

In principle, it is also possible for the first cleaning roller unit 60 and/or the second cleaning roller unit 66 to take the form of brush rollers or sweeping rollers.

Figure 4:
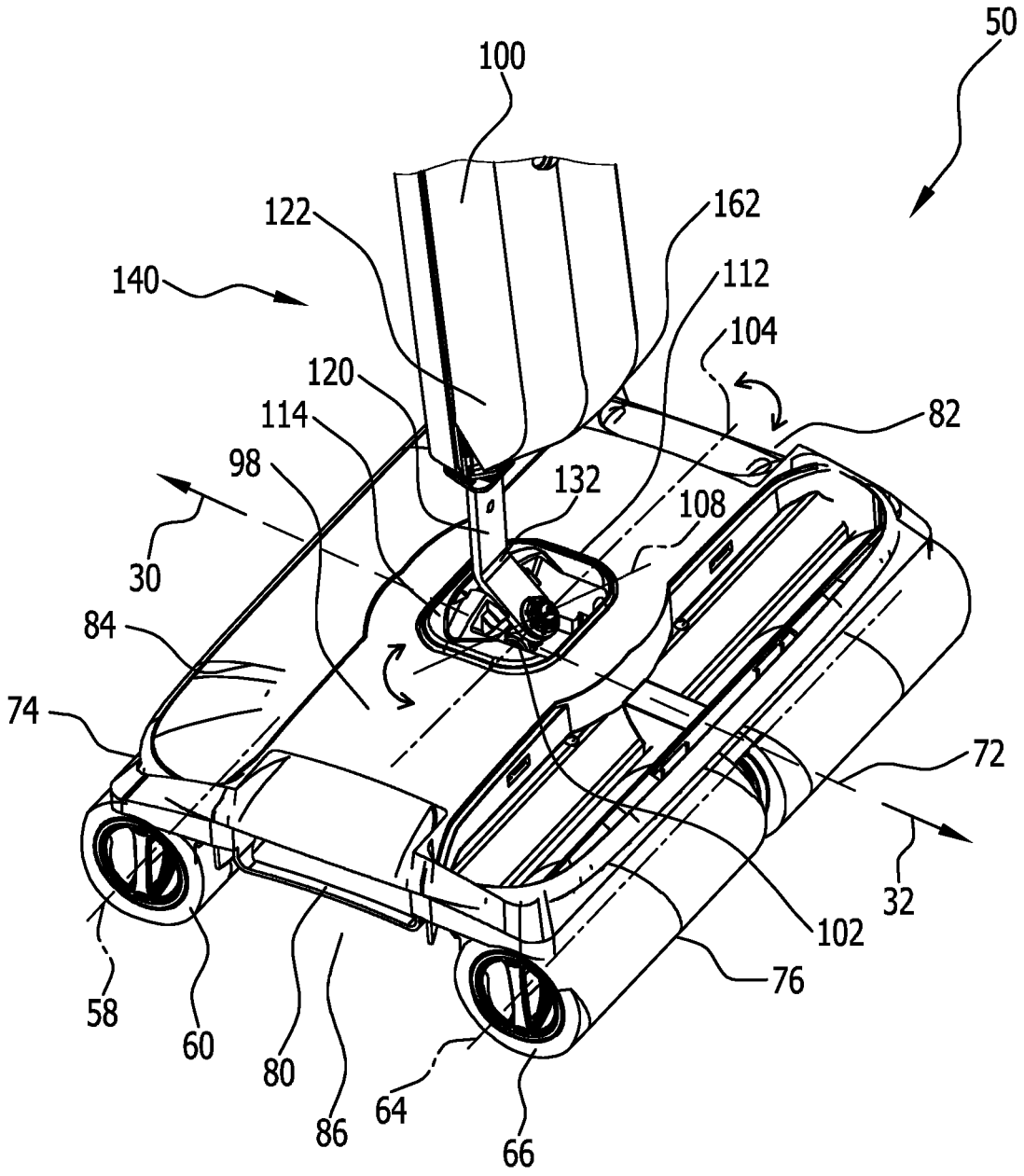
FIG. 4 is a perspective partial representation of the cleaning machine according to FIG. 3, in a first position of a holding rod device and with a casing removed.

The first axis of rotation 58 and the second axis of rotation 64 are at a spacing from one another in a longitudinal direction 72 (cf. FIG. 4). The longitudinal direction 72 is a longitudinal direction of the cleaning head 52 between a front end 74 and a rear end 76.

In particular, the straight-ahead direction of travel 30 is parallel to the longitudinal direction 72. Accordingly, the straight-back direction of travel 32 is parallel to the longitudinal direction 72.

Further associated with the cleaning head 52 is a width direction 78. This width direction 78 lies perpendicularly to the longitudinal direction 72 and at the same time parallel to the first axis of rotation 58 and the second axis of rotation 64. The cleaning head 52 extends in the width direction 78 between a first lateral side 80 and an opposite second lateral side 82.

In one embodiment, the cleaning head 52 and the cleaning roller units 60, 66 take a form such that they extend as far as the respective lateral sides 80, 82 and are in particular at least approximately flush with the first lateral side 80 and the second lateral side 82. This enables a cleaning procedure close to edges.

The head body 54 has a cover element 84. The cover element 84 upwardly covers, at least in part, the first cleaning roller unit 60 and the second cleaning roller unit 66.

Figure 7:
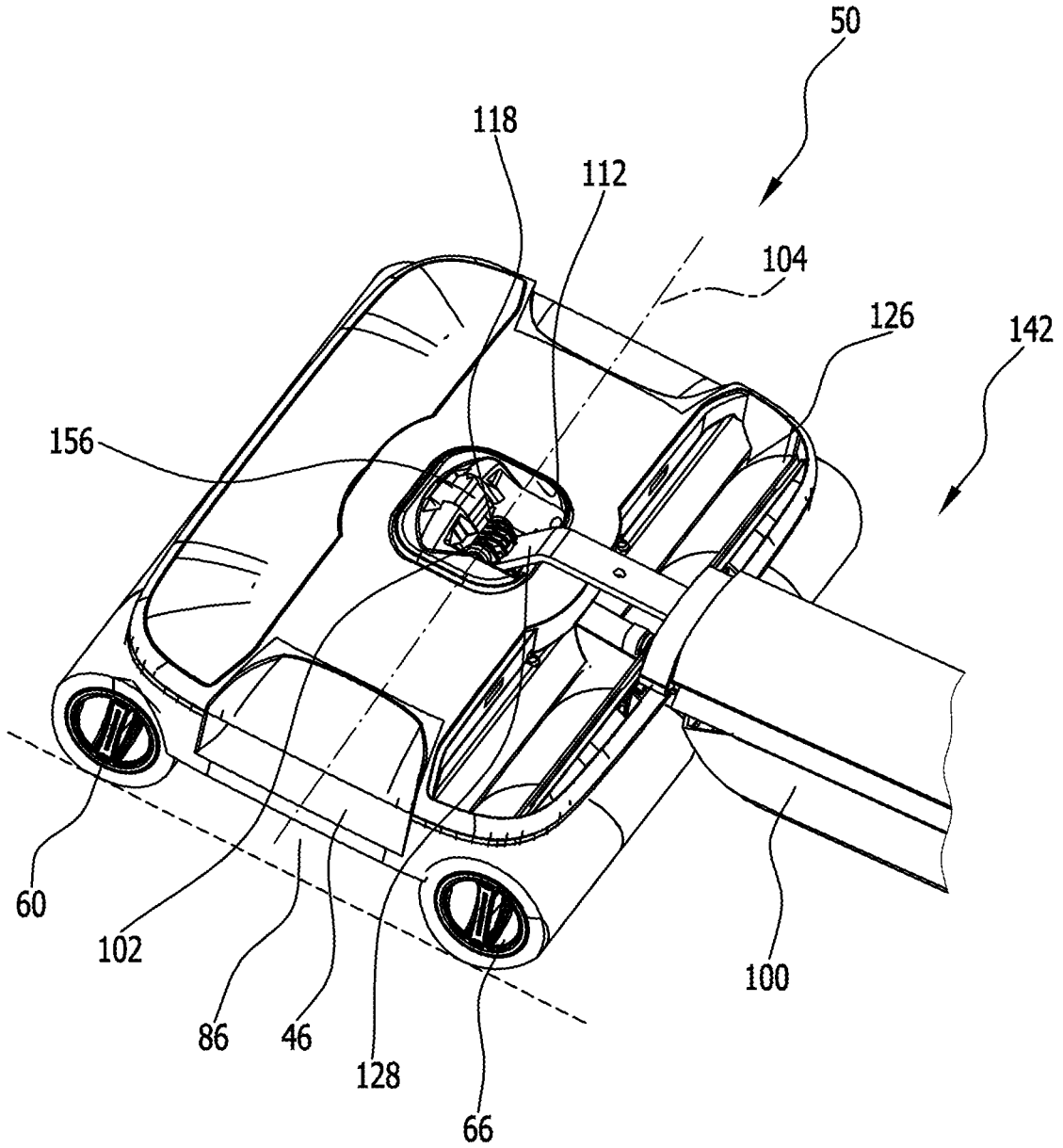
FIG. 7 shows the cleaning machine according to FIG. 3 in a representation corresponding to FIG. 4, wherein the holding rod device is in a second position in relation to the cleaning head.

Formed between the cover element 84, the first cleaning roller unit 60 and the second cleaning roller unit 66 is a free space 86. Positioned in this free space is a reservoir device 46 for dirty fluid, corresponding to the reservoir device 46 for dirty fluid in the case of the cleaning machine 10. The reservoir device 46 for dirty fluid is indicated in FIG. 7. This reservoir device 46 is not shown in FIGS. 3 to 5 or FIG. 8.

The reservoir device 46 for dirty fluid is configured to be taken off the cleaning head 52 for the purpose of emptying and where appropriate also cleaning. It is for example removable downwards from the head body 54, or can be pulled out laterally.

In principle, it is possible for dirty fluid to be removed by suction, in particular from the cleaning roller units 60, 66. An appropriate suction assembly is provided for this purpose.

In one embodiment, it is provided for dirty fluid to be drawn off the cleaning roller units 60, 66 by way of wiping strips, which are associated with the respective cleaning roller unit 60, 66 and extend for example into a textile facing (and the cleaning medium 70). Dirty fluid that has been drawn off in this way can then be removed by suction and conveyed to the reservoir device [86] 46 for dirty fluid.

In an alternative embodiment, dirty fluid is drawn off the respective wiping strips, and the reservoir device 46 for dirty fluid is arranged such that drawn-off dirty fluid may as it were be "spun" directly into the reservoir device 46 for dirty fluid without the need for a suction flow to be applied by a suction assembly.

Figure 5:
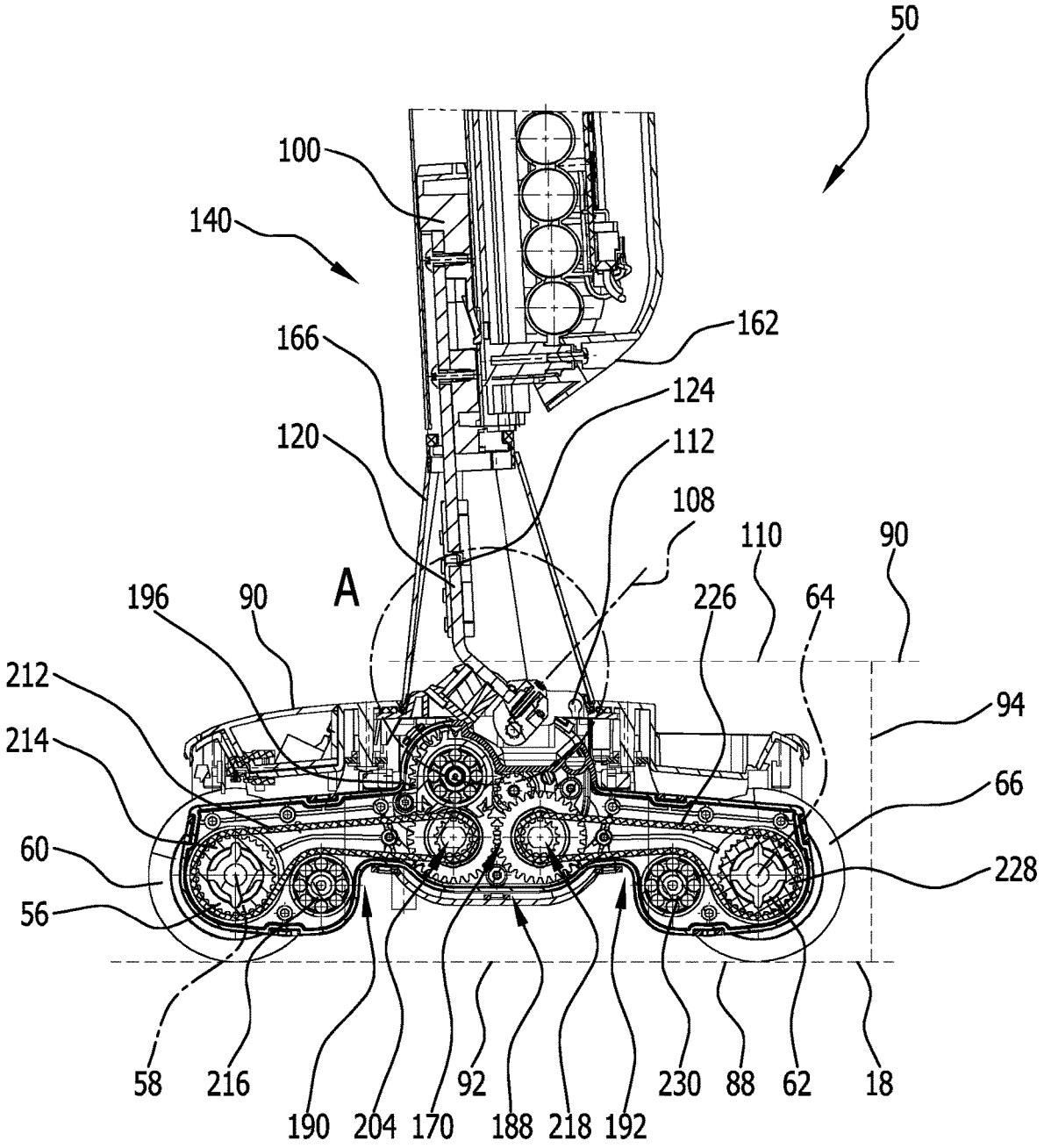
FIG. 5 is a sectional view of the cleaning machine according to FIG. 3.
Figure 6:
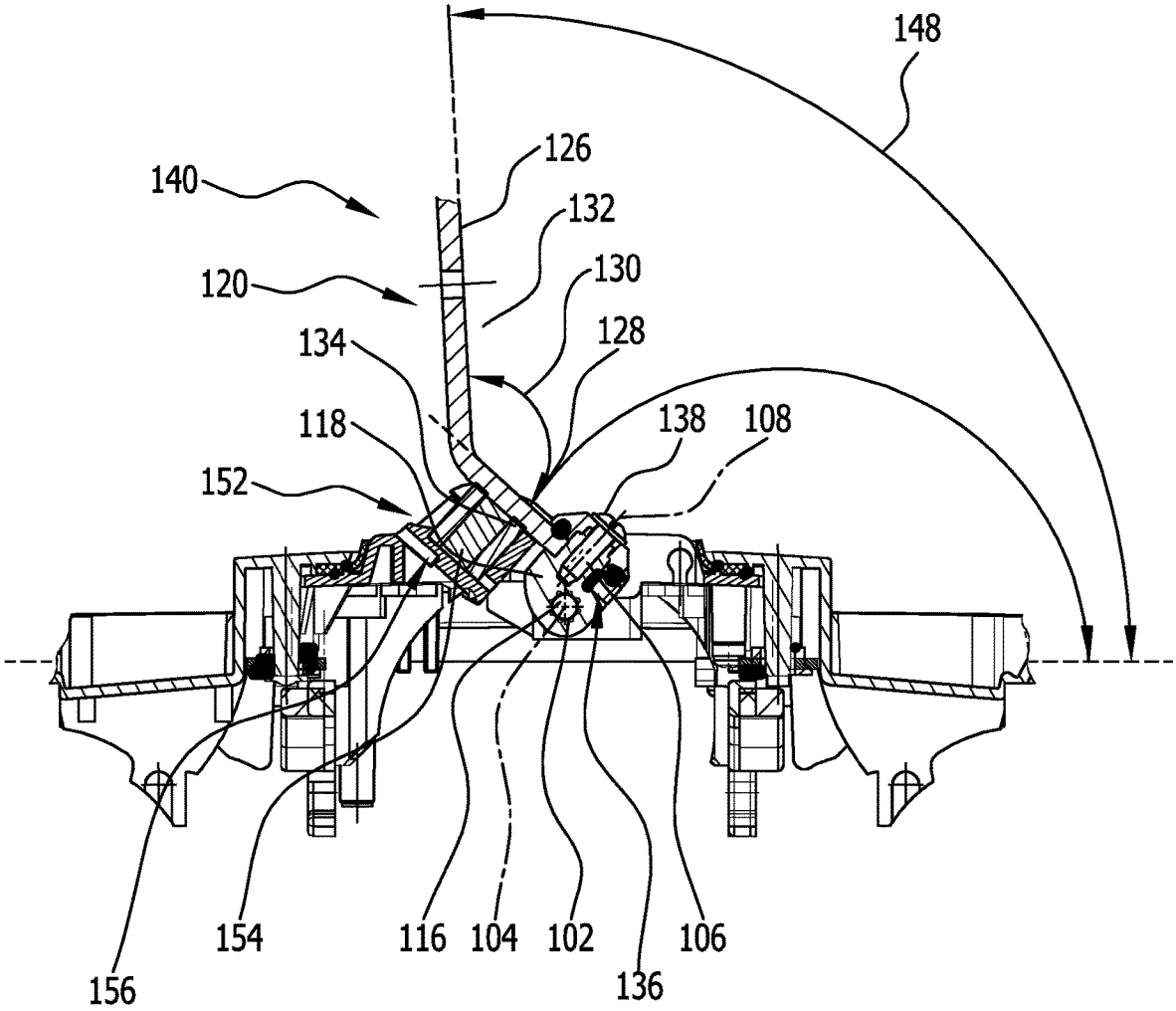
FIG. 6 is a partial representation of the region A according to FIG. 5.

The cleaning head 52 has an underside 88 and an upper side 90 (cf. for example FIG. 5). The underside 88 is defined as an enveloping plane 92 (cf. FIG. 5) of the cleaning roller units 60, 66.

When the cleaning head 52 with the cleaning roller units 60, 66 is set correctly on a surface 18 to be cleaned, the enveloping plane 92 faces this surface 18 that is to be cleaned. If the surface 18 to be cleaned is planar, the enveloping plane 92 coincides with this planar surface.

The upper side 90 is at a spacing from this underside 88 in a height direction 94. The height direction 94 extends perpendicularly to the longitudinal direction 72 and perpendicularly to the width direction.

A height and hence overall height H in the height direction 94 (FIG. 8) is defined as the spacing between the underside 88 and the upper side 90.

In one exemplary embodiment, this spacing H is defined by a joint device 96 that is arranged on or in the region of the upper side 90, and may have parts that can project over a (housing) surface of the head body 54.

Figure 8:
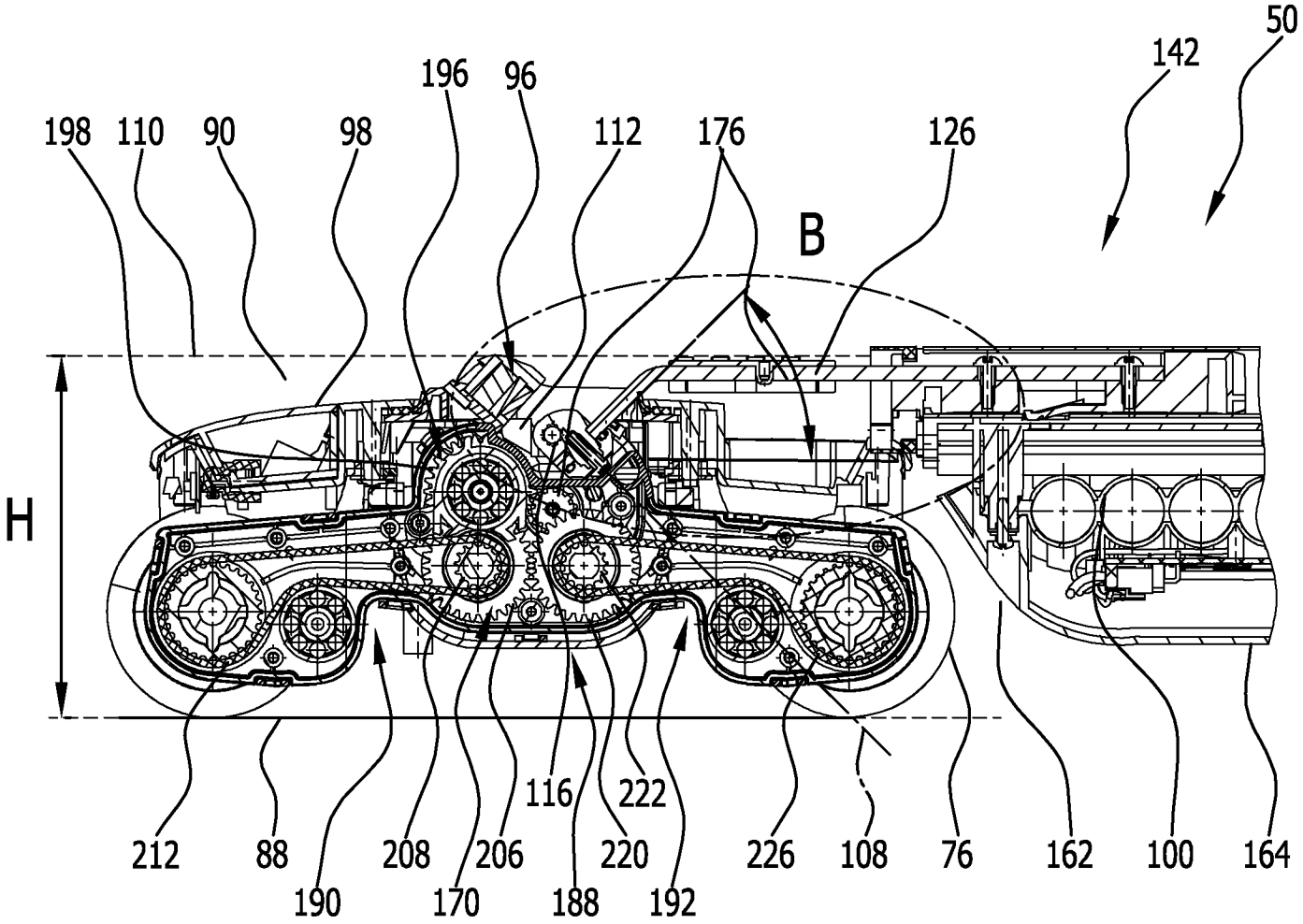
FIG. 8 is a sectional view of the cleaning machine according to FIG. 2, in the second position of the holding rod device in relation to the cleaning head.

The height H of the cleaning head 52 and the height direction 94 may in this case in particular be regarded as a height between the enveloping plane 92 and an enveloping plane 110 at a highest point on the cleaning head 52, at its upper side 90 (cf. FIGS. 5 and 8).

The height H is in particular at most 20 cm and preferably at most 15 cm and preferably at most 14 cm, or at most 13 cm, or at most 12 cm, and in particular at most 11 cm or at most 10 cm. This makes it readily possible to reach under furniture or similar with supporting legs.

It is also possible for one or more sweeping elements to be arranged on the cleaning head 52, by means of which coarse dirt is suppliable to the respective cleaning roller units 60, 66.

In this context, the reader is referred to WO 2019/048496 A1, which is incorporated herein by reference in its entirety.

A holding rod device 100 is articulated to pivot on the cleaning head 52 by way of the joint device 96.

The holding rod device 100 basically takes the same form as the holding rod device 20, and serves to allow a user, while standing on a surface 18 to be cleaned, to guide the surface cleaning machine 50 over the surface 18 to be cleaned; the surface cleaning machine 50 is manually guided.

The joint device 96 comprises a first joint 102 with a first pivot axis 104. Further, it comprises a second joint 106 with a second pivot axis 108.

The first pivot axis 104 corresponds to the first pivot axis 28 in the case of the cleaning machine 10. The second pivot axis 108 corresponds to the second pivot axis 40 in the case of the cleaning machine 10.

Formed in the cleaning head 52 at the upper side 90 is a recess 112. The recess 112 is a cavity in relation to the surface 98 of the cleaning head 52. The first joint 102 is seated in the recess 112 and hence at a lower level than the surface 98.

The recess 112 has an opening 114 at the surface 98.

In one embodiment, the first joint 102 comprises a pin element 116, which is oriented parallel to the first pivot axis 104 and is arranged set back in the recess 112 relative to the surface 98 and hence also relative to the opening 114. The pin element 116 cannot rotate in relation to the cleaning head 52.

Seated on the pin element 116 and pivotal about the first pivot axis 104 is a shaft 118. The shaft 118 surrounds the pin element 116 and receives it. The shaft 118 is likewise seated in the recess 112.

The shaft 118 takes the form in particular of an external shaft or external capsule for the pin element 116.

The first joint 102 (first pivot bearing) having the pin element 116 and the shaft 118 is arranged such that the first pivot axis 104 lies within the cleaning head 52. The first pivot axis 104 is oriented parallel to the first axis of rotation 58 and the second axis of rotation 64. It is oriented parallel to the enveloping plane 92. It is oriented perpendicularly to the longitudinal direction 72. It is oriented parallel to the width direction 78. It is oriented parallel to the enveloping plane 110.

It runs within the recess 112 and thus in particular set back relative to the upper side 90 and thus the enveloping plane 110. In particular it passes through the head body 54.

Figures 19A, 19B:
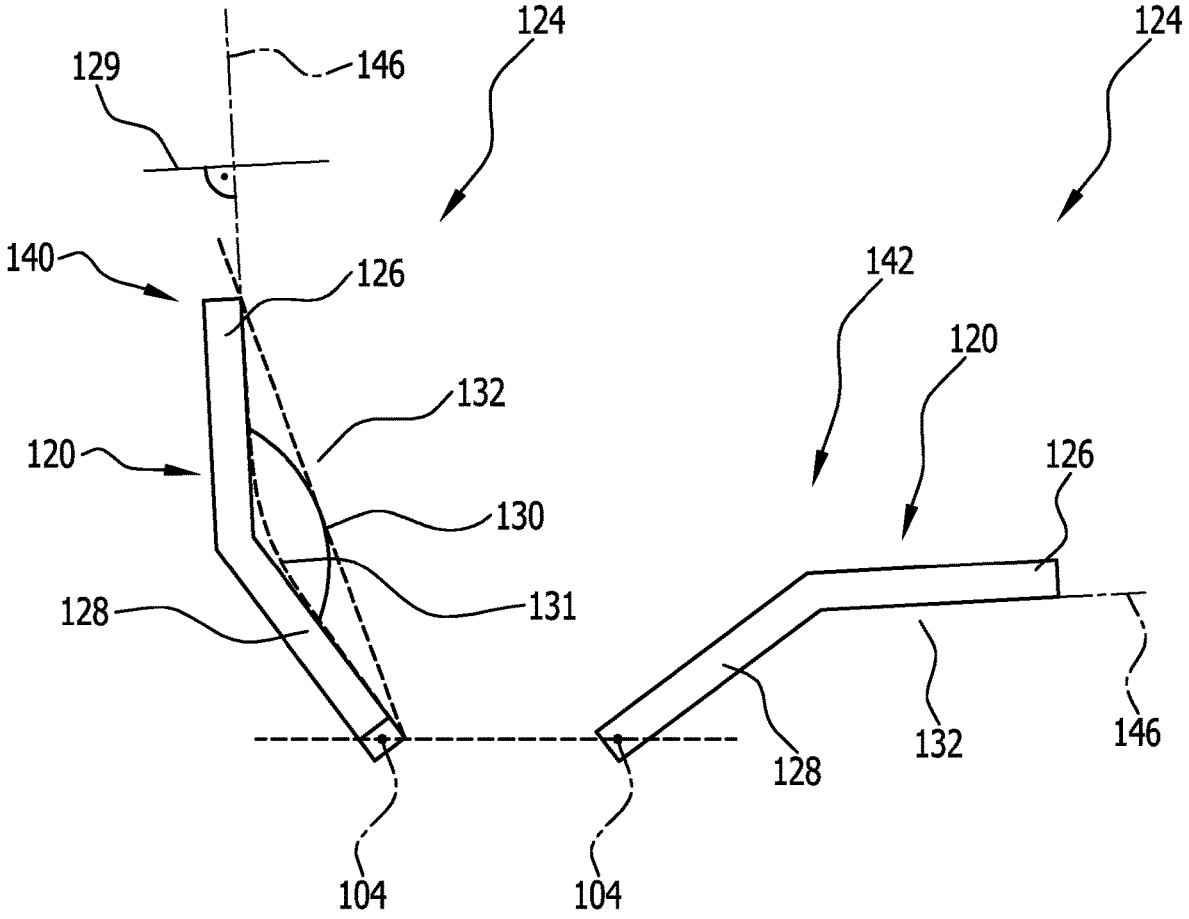
FIGS. 19(*a*), (*b*) show a side view of an exemplary embodiment of a connection element between a holding rod device and a cleaning head, in different pivotal positions.

The shaft 118 is connected to a connection element 120 (see also FIGS. 19(*a*), 19(*b*)). This connection element 120 is in turn connected to the holding rod device 100 at an underside 122 of the holding rod device 100.

The connection element 120 takes the form of an angled element 124.

The connection element 120 (cf. for example FIG. 6) has a first region 126 and a second region 128. The first region 126 and the second region 128 are in particular connected in one piece with one another. The first region 126 and the second region 128 are preferably made from a flat material.

The first region 126 and the second region 128 are offset from one another in a transverse direction 129 (cf. FIG. 19(*a*)), that is to say that they are at a spacing from one another in this transverse direction 129. The transverse direction 129 is located transversely and for example perpendicularly to a longitudinal axis 146 of the holding rod device 100.

The first region 126 and the second region 128 are oriented at an obtuse angle 130 relative to one another in order to achieve the transverse offset (in the transverse direction 129). This obtuse angle 130 (cf. FIG. 6) is in particular in the range between 120° and 150°. In a concrete embodiment, the obtuse angle 130 is approximately 135°.

The angled element 124 defines a jaw-like opening 132 at the obtuse angle 130. The jaw-like opening 132 may be regarded as the inner side of a wedge or arrow. An osculating curve 131 of the angled element 124 at the obtuse angle 130 (that is to say at the jaw-like opening 132) is concave.

The connection element 120 is connected by way of the second region 128 to the first joint 102 and thus to the shaft 118. By means of the first region 120, it is connected to the underside 122 of the holding rod device 100.

In one embodiment, the second joint 106 takes a form such that the second region 128 of the connection element 120 is pivotal in relation to the shaft 118 about the second pivot axis 108. The second joint 106 is arranged on the shaft 118.

In one embodiment, a pin element 134 that is oriented parallel to the second pivot axis 108 is arranged on the shaft 118.

The second region 128 of the connection element 120 has an opening 136 penetrated by the pin element 134. The pin element 134 is prevented from coming out by way of a securing element 138 seated on the pin element 134. The securing element 138 provides axial securing relative to the second pivot axis 108.

The second region 128, with its opening 136, forms a shaft for the securing element 138, external and pivotal about the second pivot axis 108.

The second joint 106, with the pin element 134 and the second region 128 at the opening 136, is positioned such that it penetrates at least in part into the recess 112.

The second pivot axis 108 is oriented perpendicularly to the first pivot axis 104.

It is provided for the first pivot axis 104 and the second pivot axis 108 to intersect or to be at least at a small spacing from one another. In particular, this spacing is at most 2 cm and preferably at most 1 cm.

As described above in relation to the cleaning machine 10, this allows a user to steer the cleaning head 52 on a surface 18 to be cleaned as a result of steering by the user at the holding rod device 100.

The first pivot axis 104 is a pivot axis that is fixed in relation to the cleaning head 52.

The second pivot axis 108 is an axis that is spatially variable in relation to the cleaning head 52; its position in space depends on the pivotal position at the first joint 102 about the first pivot axis 104.

In the exemplary embodiment described, the shaft 118 is a joint element common to the first joint 102 and the second joint 106. It forms a pivotal part of the first joint 102 and, in relation to the second joint 106, a fixed part about which the second region 128 is pivotal. The pin element 134 is fixedly connected to the shaft 118.

In principle, it is also possible not to provide a common joint element. Corresponding connection parts in this case are preferably at a spacing of at most 5 cm if they are not formed on a common part.

In principle, it is also possible for the second joint 106 to be arranged for example at the first region 126 of the connection element 120 or to be arranged on the holding rod device 100.

As a result of arranging the second joint 106 on the first joint 102, it is a simple matter to cause the first pivot axis 104 and the second pivot axis 108 to intersect, or to create a small spacing (at most 2 cm).

In respect of the cleaning head 52, the holding rod device 100 has an extreme first position 140 (FIGS. 3 to 6, FIG. 19(*a*)) and an extreme second position 142 (FIGS. 10 to 12, FIG. 19(*b*)).

The first position 140 and the second position 142 are extreme positions in respect of pivotability about the first pivot axis 104. The first position 140 corresponds to the first position 34 in the case of the cleaning machine 10. The second position 142 corresponds to the second position 36 there.

The holding rod device 100 is pivotal for example about the second pivot axis 108 by +/−x° in relation to a home position 144 (cf. FIG. 2). The home position 144 (FIG. 2) is defined as the pivotal position with a pivot angle of zero. For example, x is 45° or 60°.

The first position 140 and the second position 142 relate in particular to the home position 144. A pivotal range of the holding rod device 100 about the first pivot axis 104 between the first position 140 and the second position 142 is for example in the range between 75° and 105°. In one embodiment, the pivotal range is at least approximately 90° (cf. FIG. 1).

In the first position 140, the holding rod device 100 is oriented transversely to the cleaning head 52; the holding rod device 100 has a longitudinal axis 146 along which the holding rod device 100 extends. In the direction of a spacing, parallel to the longitudinal axis 146, a handle 22 is arranged on the holding rod device 100, at a spacing from the cleaning head 52.

The first region 126 is oriented in particular at least approximately parallel to the longitudinal axis 146.

In the first position 140, in particular the longitudinal axis 146 is oriented perpendicularly to the cleaning head 52. In particular, the holding rod device 100 is oriented with its longitudinal axis 146 perpendicular to the longitudinal direction 72 and perpendicular to the width direction 78.

Moreover, in the first position 140 the holding rod device 100 is oriented with its longitudinal axis 146 transverse and in particular perpendicular to the enveloping plane 92 and transverse and in particular perpendicular to the enveloping plane 110.

In the first position 140, the first region 126 of the connection element 120 is oriented transversely to the cleaning head 52 (that is to say transversely to the enveloping plane 92, and transversely to the enveloping plane 110, and transversely to the longitudinal direction 72 and the width direction 78). In particular, this orientation is perpendicular to the cleaning head 52 (see in particular FIG. 6 in this regard). A corresponding right angle is indicated by the reference numeral 148.

In the first position 140, the second region 128 of the connection element 120 is oriented at an obtuse angle 150 to the cleaning head 52 (for example to the enveloping plane 92). This obtuse angle 150 is the difference in angle between 270° and the obtuse angle 130. If the obtuse angle 150 is designated $\alpha$ and the obtuse angle 130 is designated $\beta$, then $\alpha=270°-\beta$.

In the first position 140, the jaw-like opening 132 of the angled element 124 faces the rear end 76 (cf. FIG. 4). If the angled element 124 is regarded as an arrow, then the arrow tip points towards the front end 74.

There is provided a fixing device 152 that secures the first position 140 of the holding rod device 100, and in so doing secures it in particular with force locking.

In one exemplary embodiment, the fixing device 152 takes the form of a magnet device in which the first position 140 of the holding rod device 100 is secured in relation to the cleaning head 52 with force locking, by way of magnetic retaining forces.

In one embodiment, the fixing device 152 comprises a magnet 154 that is arranged on the cleaning head 52. The magnet 154 is part of a magnet system that takes the form of a sandwich-type system and is designated 156. With this magnet system 156, the magnet 154 is arranged between two flat iron poles 158. The magnetic force in the magnet system 156 is intensified in the sandwich-type system.

The magnet system 156 is arranged such that in the first position 140 it acts on the second region 128 of the connection element 120. In particular, the magnet system 156 is arranged such that in the first position 140 there is mechanical contact between the second region 128 and thus in particular on a side remote from the jaw-like opening 132.

The magnet system 156 has a magnetic retaining force, wherein the retaining forces acts on the second region 128. In the second region 128, the connection element 120 is made from an appropriate material, such as a ferromagnetic material, so that the corresponding retaining force is effective.

When the holding rod device 100 is in the first position 140 in relation to the cleaning head 52 and thus the second region 128 abuts against the magnet system 156, the magnet system 156 provides an appropriate retaining force that secures this first position 140. A particular application of force is required to move the holding rod device 100 out of the first position 140.

The magnet system 156 in conjunction with the connection element 120 is dimensioned in particular such that if, with the surface cleaning machine 50 in the first position 140 of the holding rod device 100 in relation to the cleaning head 52, the surface cleaning machine 50 is placed, with the first position 140 fixed, on a subsurface that is inclined by 10° in relation to the direction of gravity, the holding rod device 100 will not simply move out of the first position 140 by itself (because of gravitational forces). Thus, for this inclination of (at least) 10° the first position 140 is secured.

In the embodiment described, the second region 128 of the connection element 10 takes a form such that it can be retained by a magnetic retaining force. In principle, it is also possible for an additional element such as a ferromagnetic element to be arranged on the second region 128 such that the appropriate retaining force can be exerted.

The magnet system 156 is arranged at the recess 112. It may be positioned partly in the recess 112.

In particular, the enveloping plane 110 is predetermined by the magnet system 156.

The surface cleaning machine 50 has its greatest extent in the height direction 94 when it is in the first position 140.

The second position 142 may be produced by pivoting from the first position 140 about the above-mentioned pivot angle, which is for example approximately 90°.

In the second position 142 of the holding rod device 100 (FIGS. 7 to 11), the longitudinal axis 146 of the holding rod device 100 is oriented at least approximately parallel to the cleaning head 52 and at the same time in particular at least approximately parallel to the enveloping plane 92 and the enveloping plane 110. Here, the expression "at least approximately" means that there may be a deviation of +/−10° from exactly parallel, or of +/−5°.

In particular, the first region 126 of the connection element 120 is then oriented at least approximately parallel to the cleaning head 52 (in particular to the enveloping plane 92).

In the second position 142, the second region 128 of the connection element 120 is oriented at an acute angle 160 (cf. FIG. 9) to the cleaning head 52 (to the enveloping plane 92 and the enveloping plane 110). The acute angle 160 here corresponds to the difference between 180° and the obtuse angle 130 β. If the acute angle 160 is designated by γ, then γ=180°-β.

Figure 9:
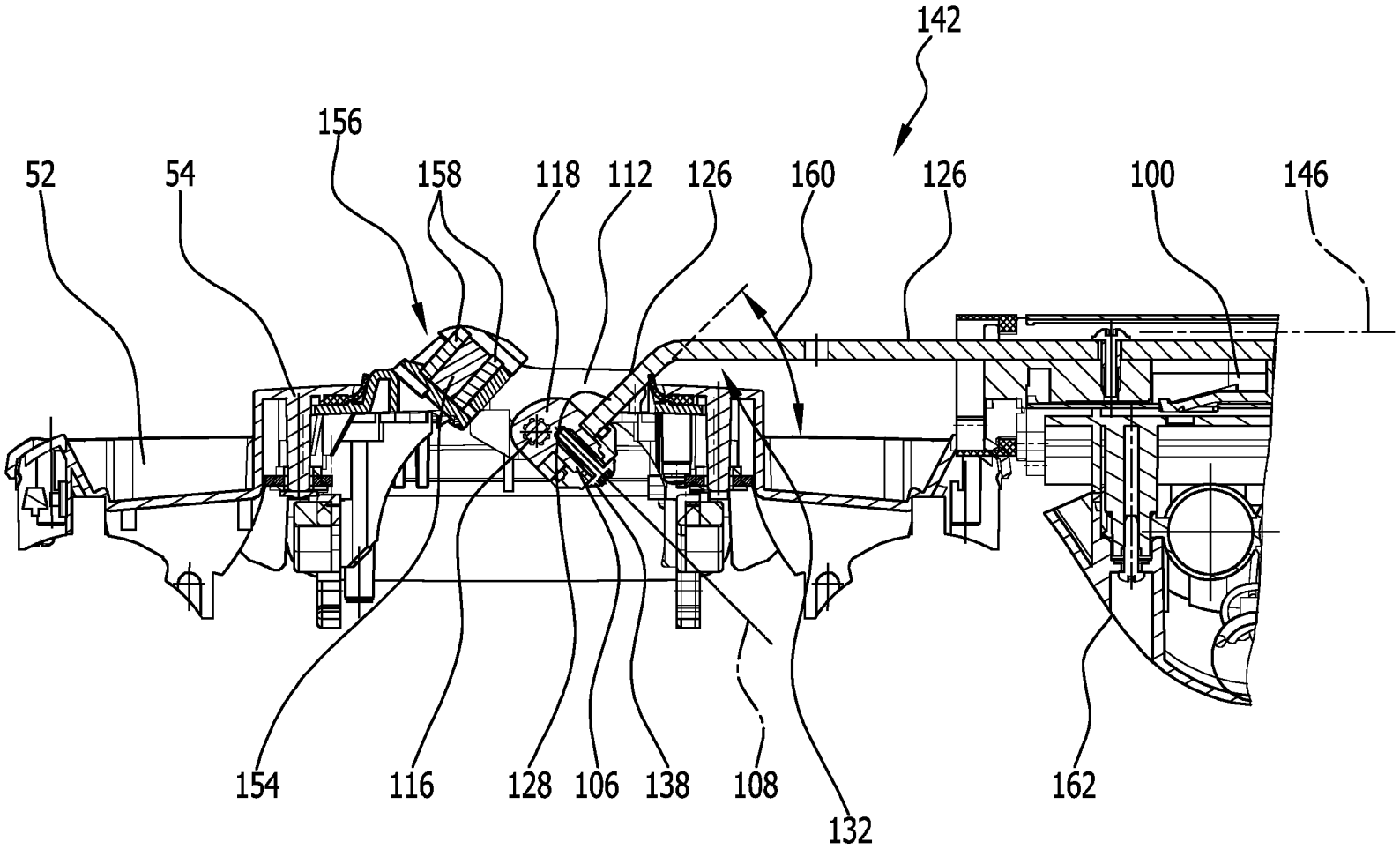
FIG. 9 is an enlarged representation of the region B according to FIG. 8.
Figure 11:
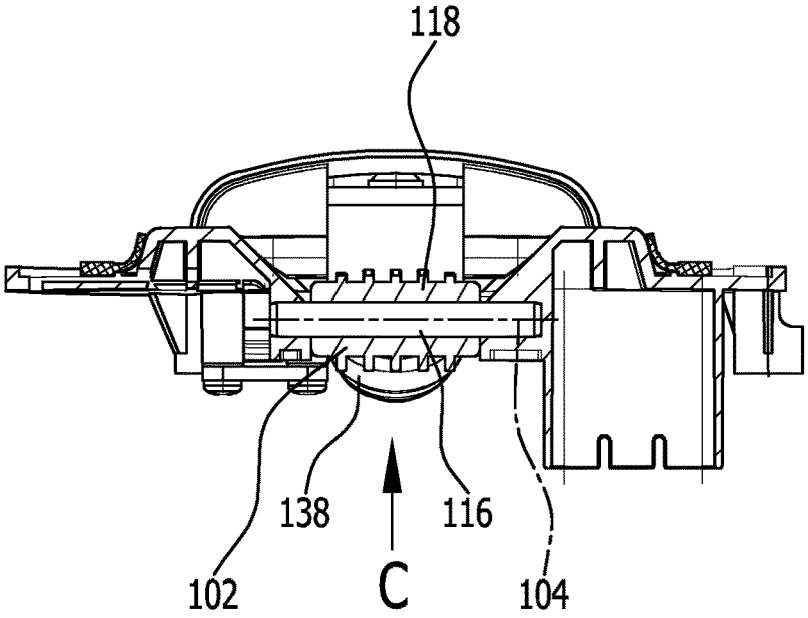
FIG. 11 is a sectional view along the line 11-11 according to FIG. 10.
Figure 10:
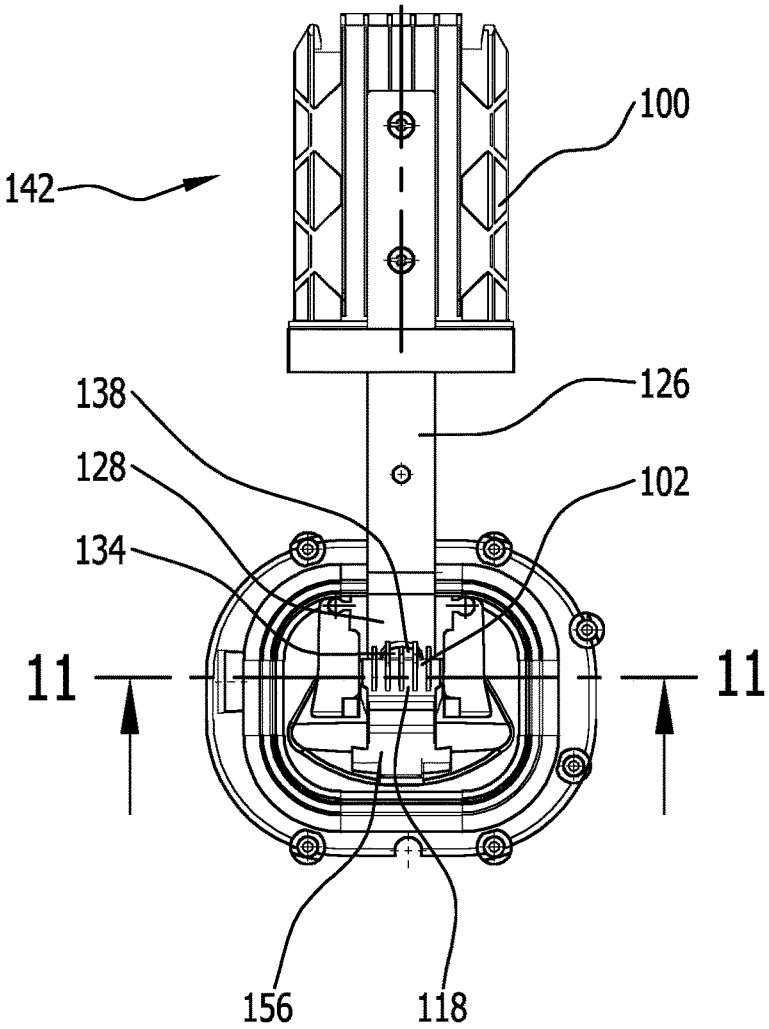
FIG. 10 shows an exemplary embodiment of a joint device for the cleaning machine according to FIG. 3.
Figure 12:
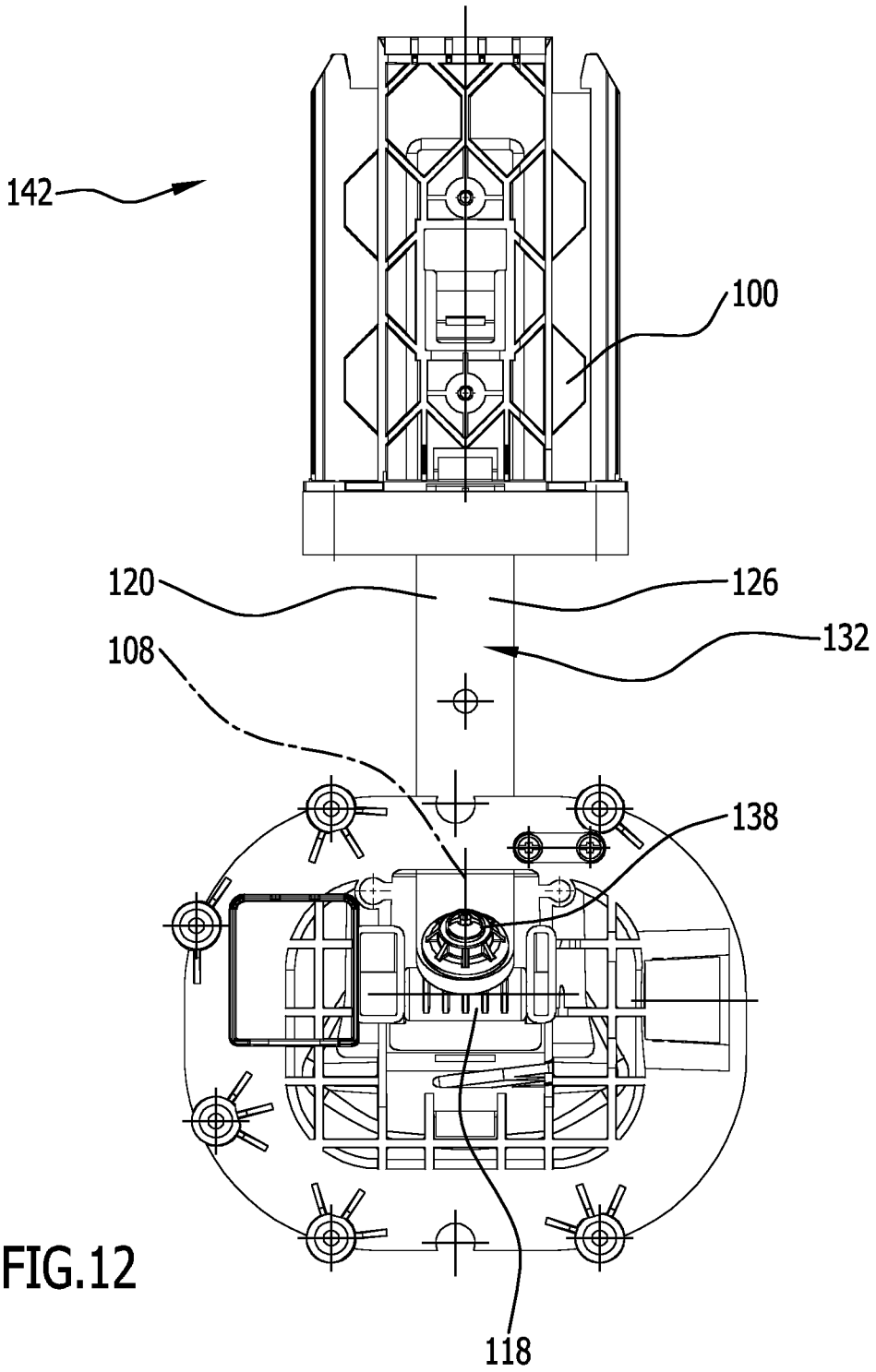
FIG. 12 is a view of the joint device in the direction C according to FIG. 11.

The jaw-like opening 132 of the connection element 120 is in this case such that it "takes in" part of the region of the upper side 90 at the recess 112 (cf. for example FIG. 9).

The surface cleaning machine 50 has its smallest dimensions in the height direction 94 when it is in the second position 142 of the holding rod device 100. Substantially, in the second position 142 the surface cleaning machine 50 has the height H including the holding rod device 100.

The holding rod device 100 has a region 162 that faces the cleaning head 52 and has a transverse extent in relation to the longitudinal axis 146. This region 162 is for example formed on a housing of the holding rod device 100. In the second position 142, this region 162 faces the rear end 76 of the cleaning head 52 (cf. for example FIG. 8).

Further, in the second position 142 it is provided in particular for this region 162 of the holding rod device 100 to lie below the upper side 90 of the cleaning head 52.

The holding rod device 100 is arranged and formed, in particular in relation to the cleaning head 52, such that by means of an underside 164 (cf. FIG. 8) it does not project beyond the enveloping plane 92 and is in particular set back in relation thereto.

Arranged on the holding rod device 100 there is for example a reservoir device for cleaning liquid. In one embodiment, a suction assembly may be arranged on the holding rod device 100. In the case of a battery-operated surface cleaning machine 50, in particular a battery holder with battery is arranged on the holding rod device 100.

Figure 3:
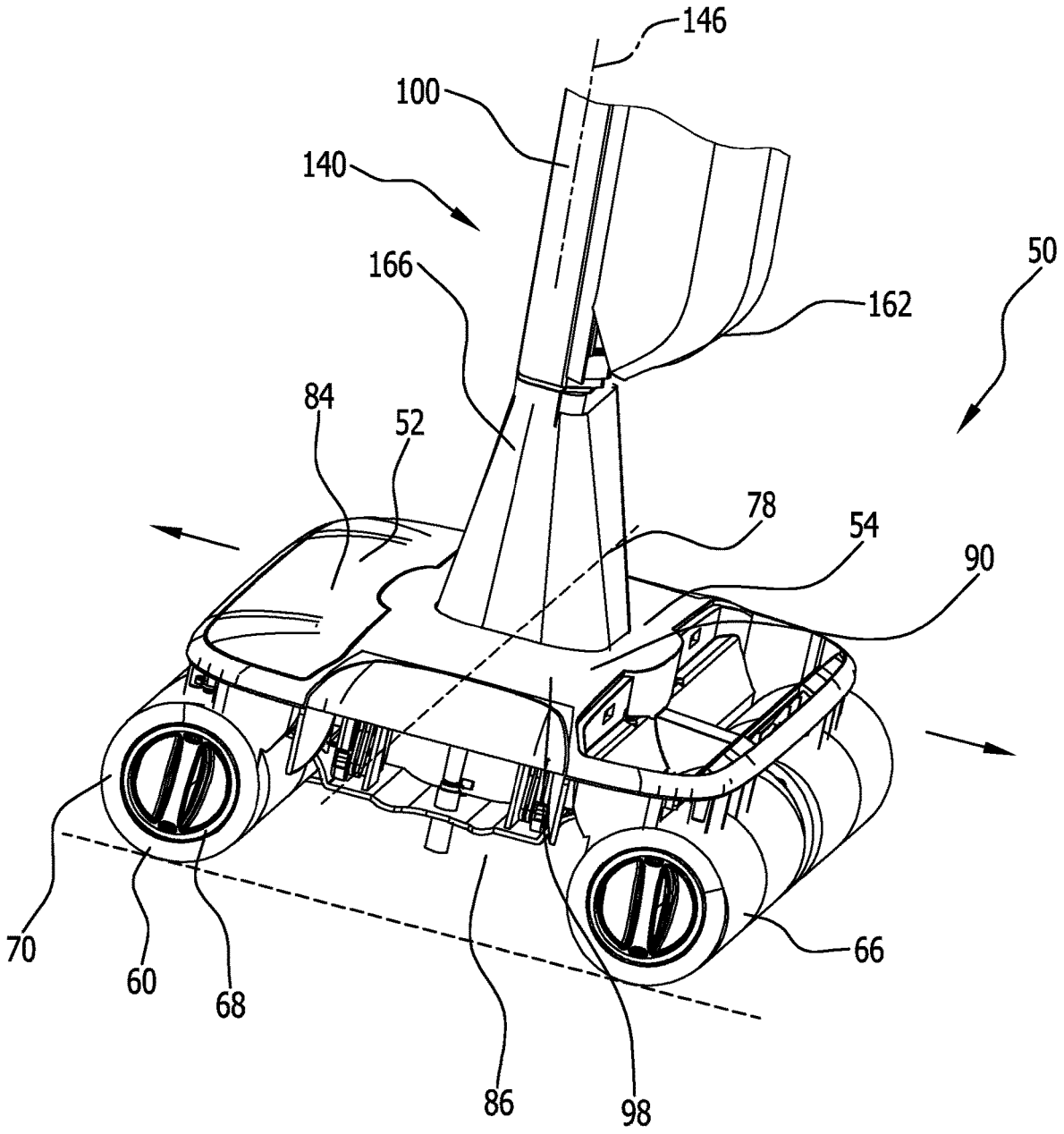
FIG. 3 is a partial representation of an exemplary embodiment of a cleaning machine according to the invention, with a cleaning head.

Between the cleaning head 52 and the holding rod device 100 there is arranged a casing 166 (FIG. 3, FIG. 5; this casing 166 is not shown in FIGS. 4, 6, 7, 8, 9).

Positioned in the casing 166 is the connection element 120. The casing 166 is a casing for the joint device 96. Here, the casing 166 is in contact with the cleaning head 52 in particular at the upper side 90 or the surface 98, and accordingly is in contact with the holding rod device 100. The casing 166 ensures fluid-tight sealing.

In particular, the casing 166 also covers over the recess 112 and its opening 114.

The casing 166 takes the form for example of a textile bag or rubber bag.

The connection element 120 may be an integral part of the holding rod device 100, or it is for example a separate part from the holding rod device 100 and is connected to the holding rod device 100 by screws, welding, etc.

Figures 20A, 20B:
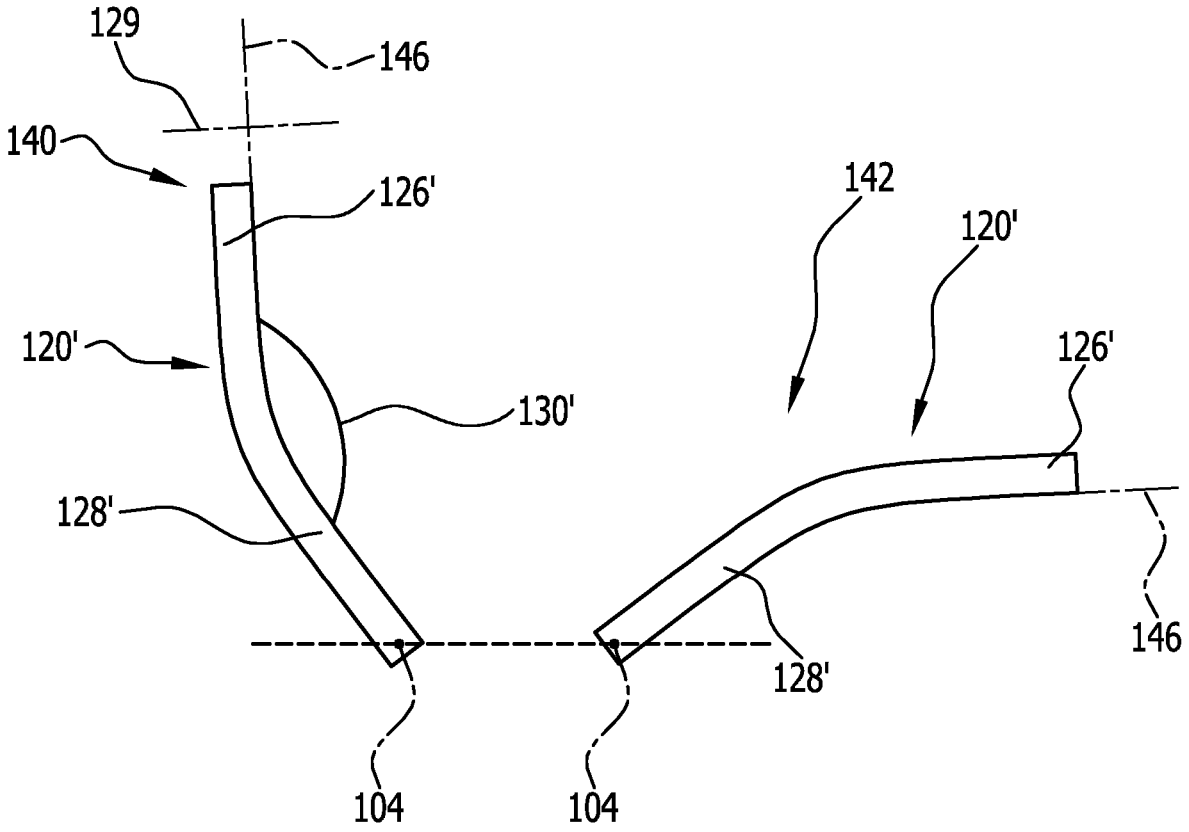
FIGS. 20(*a*), (*b*) show a further exemplary embodiment of a connection element in different pivotal positions.

In an alternative embodiment of a connection element, a connection element 120' is provided, which takes the form of a curved element (FIGS. 20(*a*), (*b*)). This curved element 120' has a first region 126' connected to the holding rod device 100 and a second region 128' connected to the joint device 96. The first region 126' merges seamlessly as it were with the second region 128'.

In relation to tangential planes or enveloping planes, at both the first region 126' and the second region 128', these meet at an obtuse angle 130'.

As a result of the curved form taken by the connection element 120' (taking the form of a curved element), a spacing is formed between the first region 126' and the second region 128' in the transverse direction 129. This gives the advantages described above in the context of the connection element 120; in the first position 140 of the holding rod device 100 relative to the cleaning head 52 (with the holding rod device 100 connected to the cleaning head 52 by way of the connection element 120'), a fixing device 152 can be produced by way of the connection element 120'. In particular, a region of the connection element 120' can be used as the counter-element (retaining device) for a magnet.

In the second position 142 (FIG. 20(*b*)), the height of the surface cleaning machine in the height direction 94 can be kept small. Here, the cleaning head 52 need not be modified in respect of the cleaning roller units 60, 66 in order to minimise the height in the height direction 94; in particular, there is no need to provide a recess at the cleaning head 52 in the region of the cleaning roller units 60, 66. Minimising the height does not impair the cleaning function or the cleaning. The second cleaning roller unit 66, as the rear cleaning roller unit, may take the same form as the first cleaning roller unit 60.

Figures 21A, 21B:
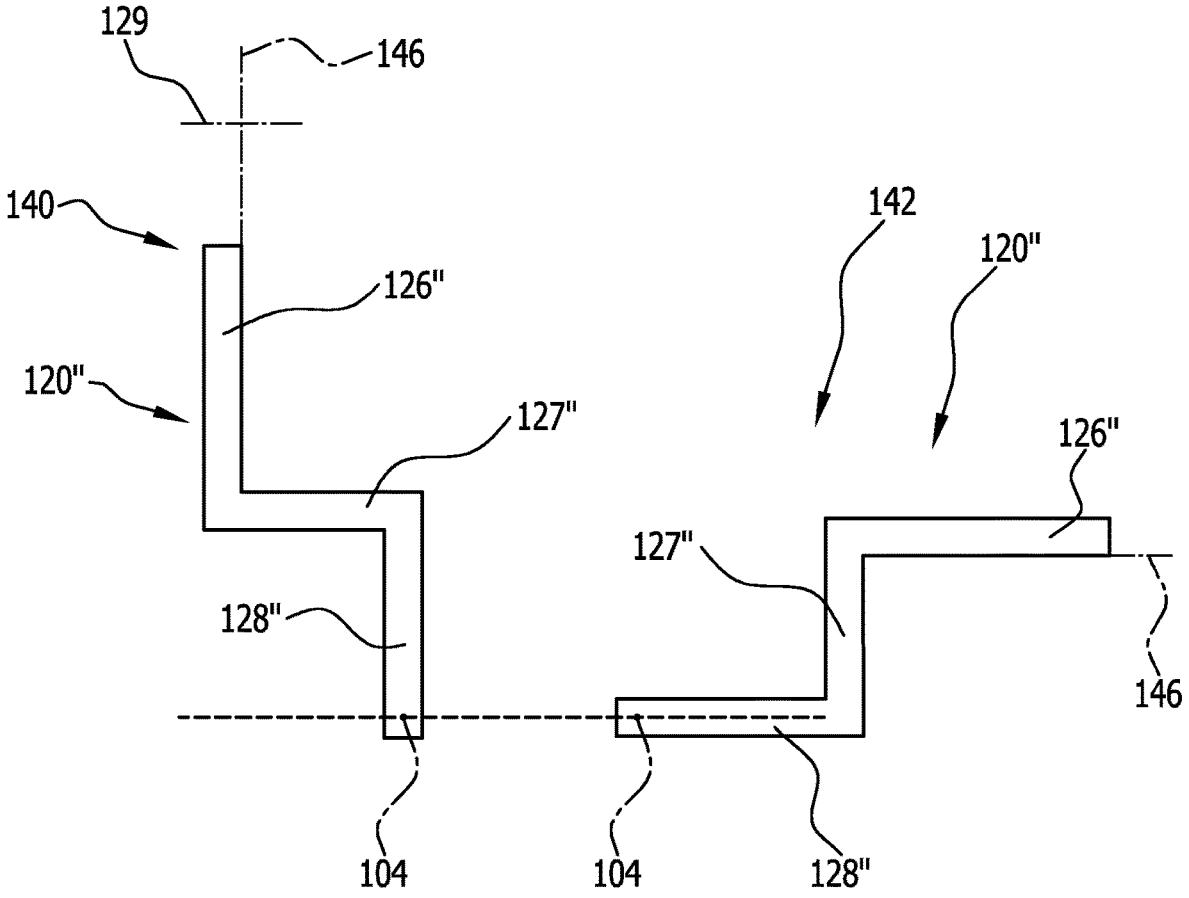
FIGS. 21(*a*), (*b*) show a further exemplary embodiment of a connection element in different pivotal positions.

In a further exemplary embodiment of a connection element 120" (FIGS. 21(*a*), (*b*)), there is provided a first region 126" that is connected by way of a transverse web 127" to a second region 128". The first region 126" is connected to the holding rod device 100. The second region 128" is connected to the joint device 96. The first region 126" and the second region 128" are not connected directly to one another, but rather the transverse web 127" provides a connection region between the first region 126" and the second region 128".

The first region 126" and the second region 128" take the form for example of flat elements.

It may also be provided for the transverse web 127" to take the form of a flat element.

The transverse web 127" is oriented transversely to the first region 126" and the second region 128".

In the exemplary embodiment shown in FIGS. 21(*a*) and (*b*), the first region 126" and the second region 128" are oriented parallel to one another. The transverse web 127" is oriented perpendicularly to the first region 126" and the second region 128".

Other formations are also possible here, for example in the manner of a Z.

The first region 126" and the second region 128" are at a spacing from one another in the transverse direction 129, as a result of the transverse web 127".

Here, it is provided that, in the first position 140 (FIG. 21(*a*)) of the holding rod device 100 in relation to the cleaning head 52, the second region 128" is oriented transversely and for example perpendicularly to the cleaning head 52.

In the second position 142, the second region 128" is oriented for example at least approximately parallel (that is to say at an angle of zero, or a small angle close to 0°) to the cleaning head 52 (FIG. 21(*b*)).

This results in the advantages that were explained in the context of the connection element 120 or 120', relating to minimising the height of the surface cleaning machine in the second position 142.

Figure 13:
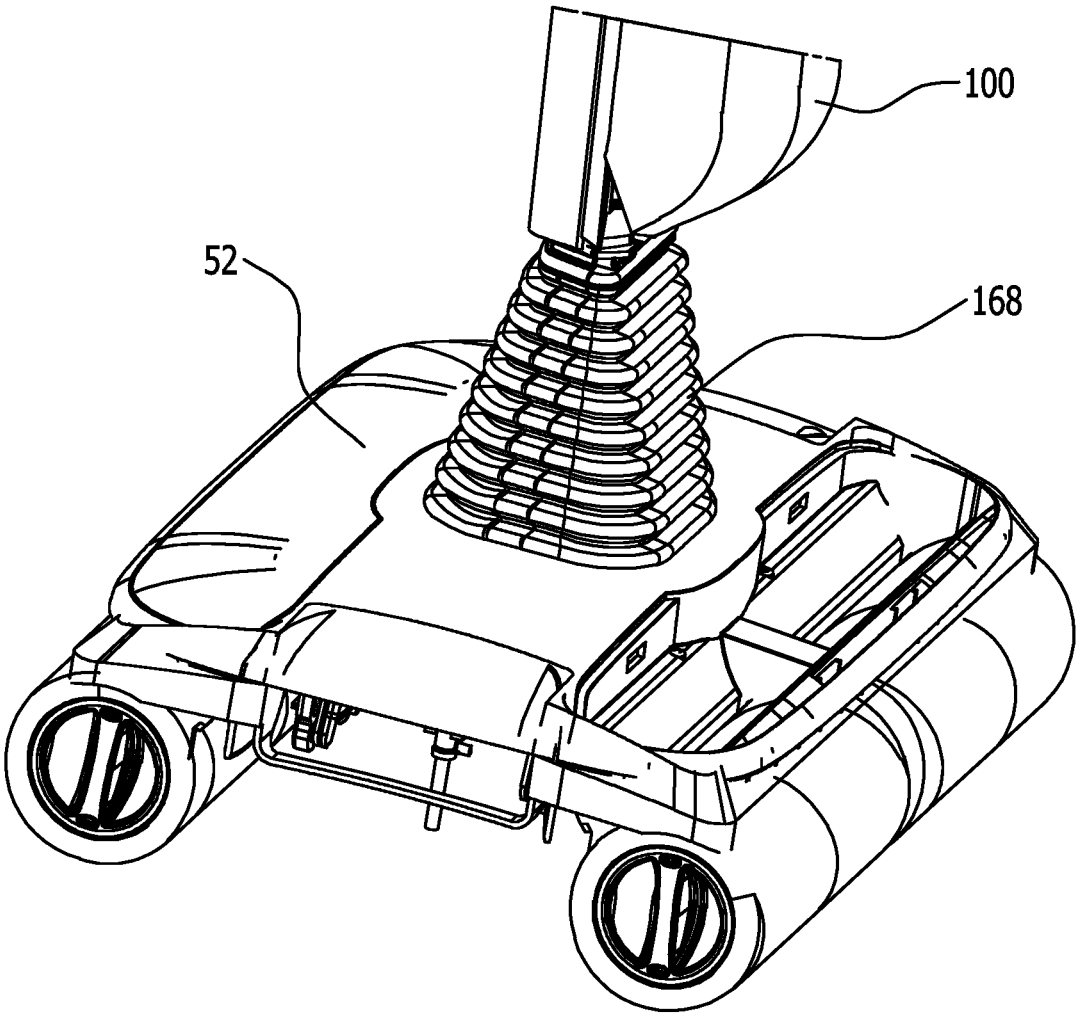
FIG. 13 shows a variant of an exemplary embodiment of a cleaning machine, in partial representation.

In one embodiment, the casing 166 takes the form of a bellows 168 (FIG. 13).

Arranged on the cleaning head 52 is a drive device 170 for rotary driving of the first shaft 56 and the second shaft 62 (and hence the first cleaning roller unit 60 and the second cleaning roller unit 66) (FIGS. 5, 8, 14 to 18).

The drive device 170 is positioned geometrically between the first cleaning roller unit 60 and the second cleaning roller unit 66.

The drive device 170 comprises a drive motor 172, which is an electric motor. The drive motor 172 is fed by mains current, or an in particular rechargeable battery device is provided, which is positioned in particular on the holding rod device 100, and this provides corresponding battery current to the drive motor 172.

The drive motor 172 has a motor shaft 174. Seated on the motor shaft 174 such that it cannot rotate in relation thereto is a drive gearwheel 176. The motor shaft 174 rotates about an axis of rotation (drive axis) 178. The axis of rotation 178 lies in particular parallel to the first axis of rotation 58 and the second axis of rotation 64 of the corresponding cleaning roller units 60, 66.

The axis of rotation 178 is in this case in particular parallel to the first pivot axis 104.

In relation to the height direction 94, the drive motor 172 is positioned above the reservoir device 86 for dirty fluid.

In one embodiment, a motor speed (speed of rotation of the motor shaft 174) is approximately 6 400 revolutions per minute.

A desired speed of rotation of a cleaning roller unit 60, 66 is in the region of 500 revolutions per minute.

The drive device 170 comprises a gear device 180. The gear device 180 has in particular the tasks of providing a step down from the speed of the motor shaft 174, bridging spatial distances between the motor shaft 174 and the shafts 56, 62 and, in one embodiment, also ensuring driving of both the first cleaning roller unit 60 and the second cleaning roller unit 66 by means of a single drive motor 172. In particular here, rotation of the first cleaning roller unit 60 and the second cleaning roller unit 66 in opposite directions is provided.

Figure 14:
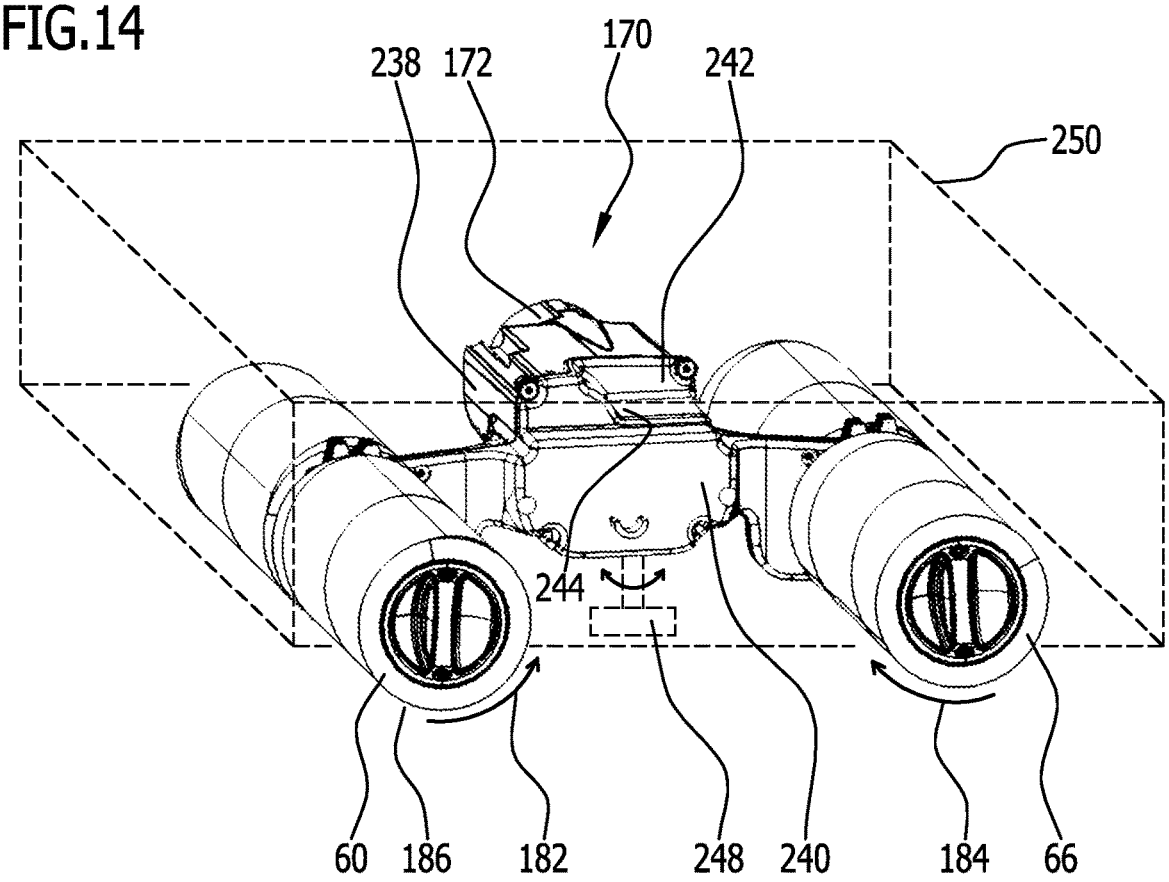
FIG. 14 shows an exemplary embodiment of a combined unit comprising a drive device and a roller unit for the cleaning machine according to FIG. 3.
Figure 15:
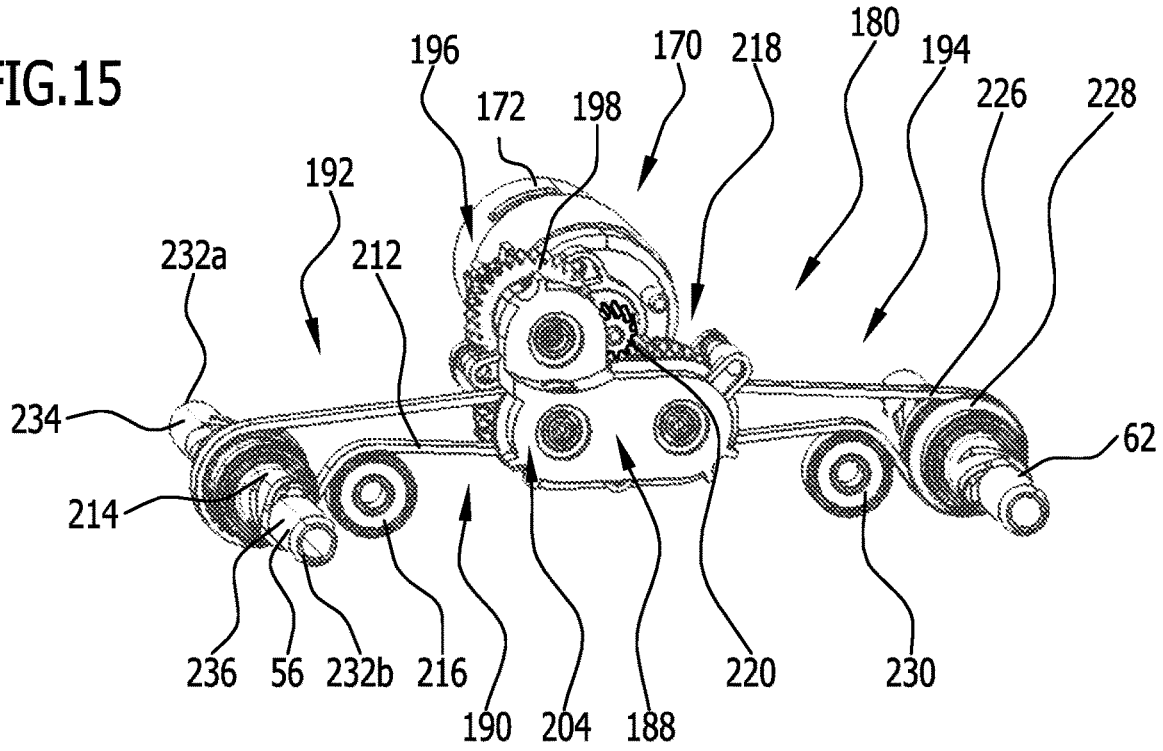
FIG. 15 is a view of the drive device according to FIG. 14.
Figure 16:
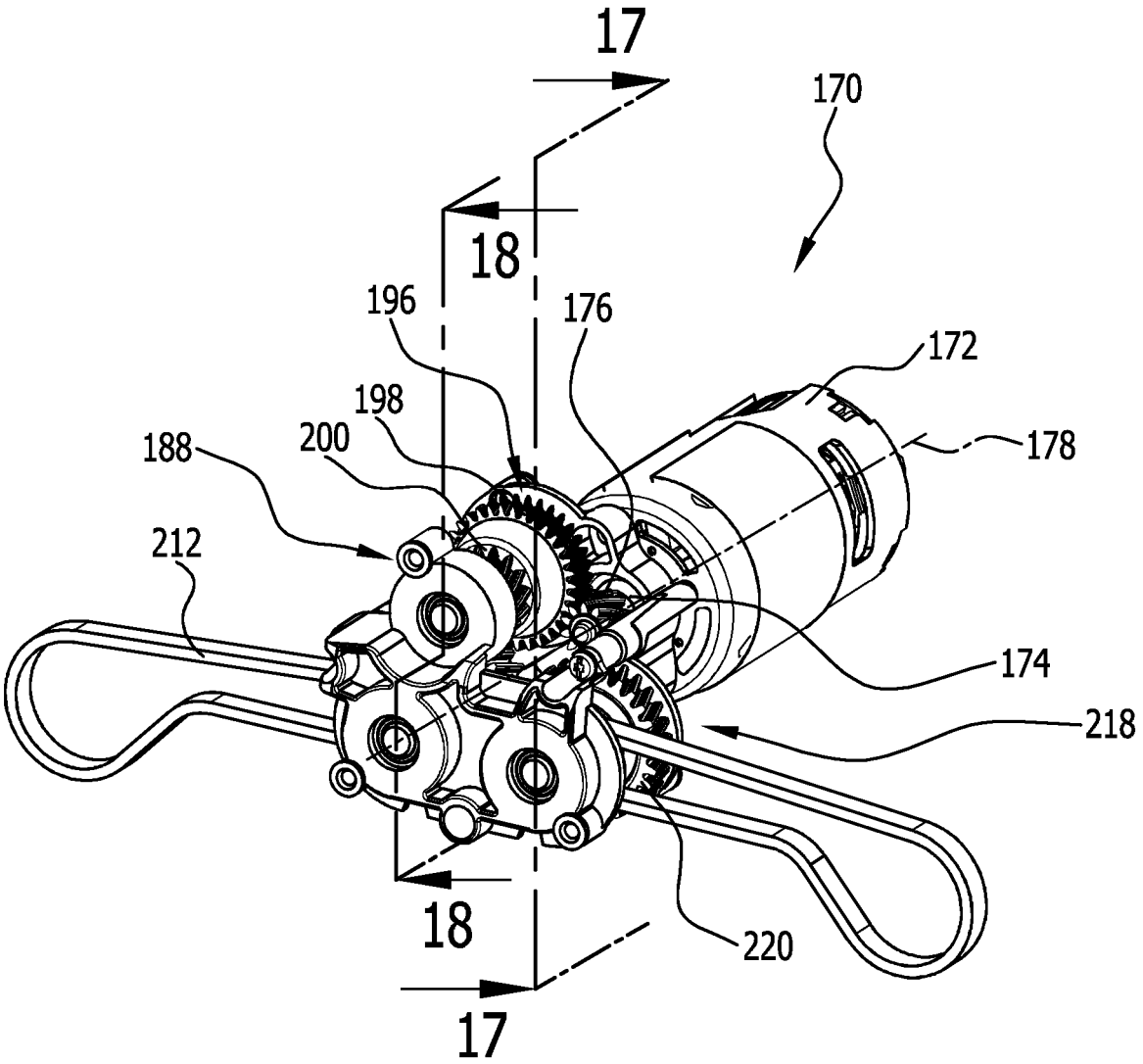
FIG. 16 is a perspective representation similar to FIG. 15.
Figure 17:
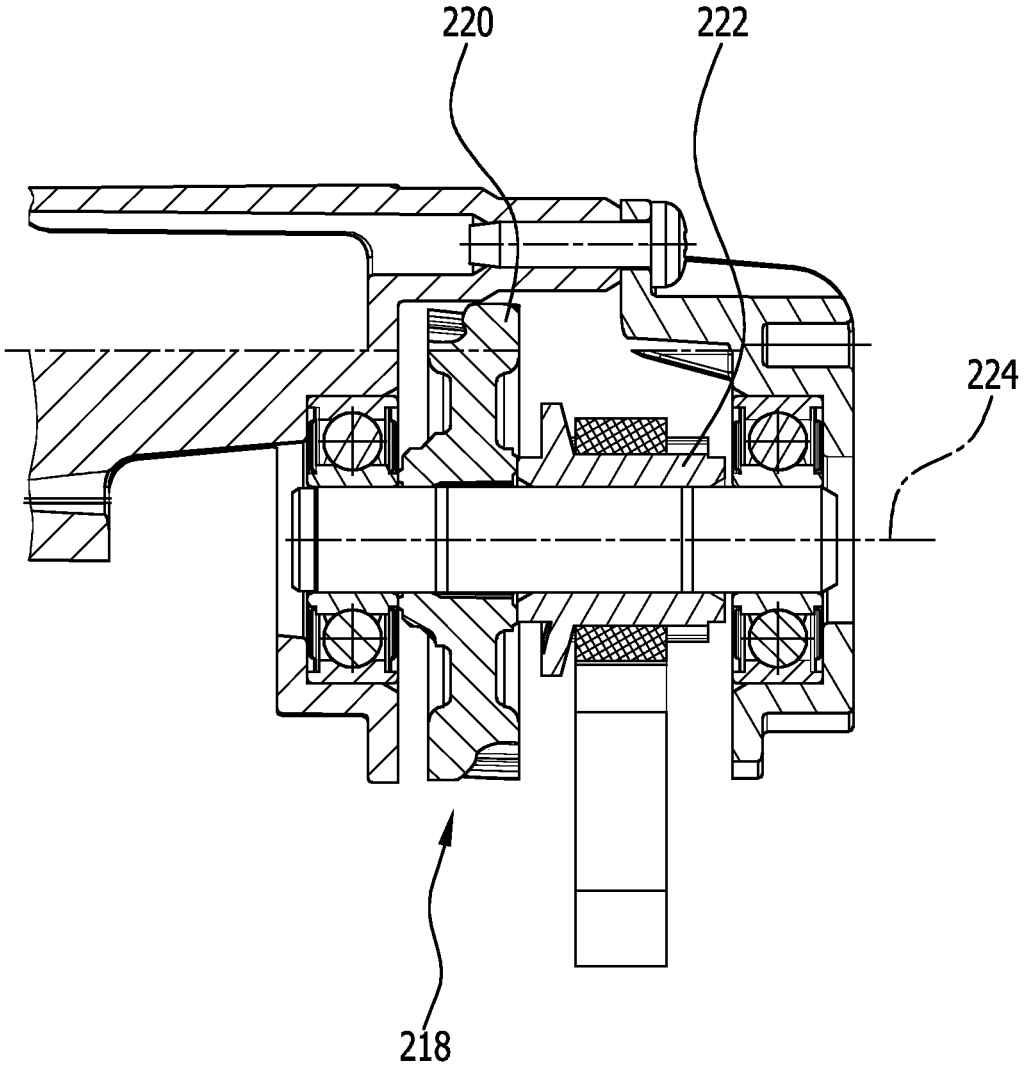
FIG. 17 is a sectional view along the plane designated 17-17 according to FIG. 16.

In FIG. 14, a first direction of rotation of the first cleaning roller unit 60 about the first axis of rotation 58 is indicated by the reference numeral 182. A corresponding second direction of rotation 184 for rotation of the second cleaning roller unit 66 about the second axis of rotation 64 is indicated by the reference numeral 184.

In this embodiment, the first direction of rotation 182 and the second direction of rotation 184 are opposite to each other, that is to say that the cleaning roller units 60, 66 are driven in opposite directions by the drive device 170.

The directions of rotation 182, 184 are in this case in particular such that, after contact with the surface 18 that is to be cleaned, a certain region 186 on a cleaning roller unit (in the example according to FIG. 14, the first cleaning roller unit 60) moves in the direction of the reservoir device 86 for dirty fluid. As a result, the path that dirt entrained by the cleaning roller unit 60 is to take to the reservoir device 86 for dirty fluid is shorter than in an opposite direction of rotation.

The gear device 180 has a pinion arrangement 188. The pinion arrangement 188 is coupled directly to the motor shaft 174. In particular, the pinion arrangement 188 comprises a two-stage step-down gear.

Further, the gear device 180 has a belt arrangement 190. The belt arrangement 190 couples the pinion arrangement 188 to the shafts 56, 62 in a manner applying torque.

In one embodiment, the belt arrangement 190 comprises a first part 192 and a second part 194. The first part 192 of the belt arrangement 190 couples the pinion arrangement 188 to the first shaft 56 in a manner applying torque. The second part 194 of the belt arrangement 190 couples the pinion arrangement 188 to the second shaft 62 in a manner applying torque.

The belt arrangement 190 in particular takes the form of a one-stage step-down gear.

Figure 18:
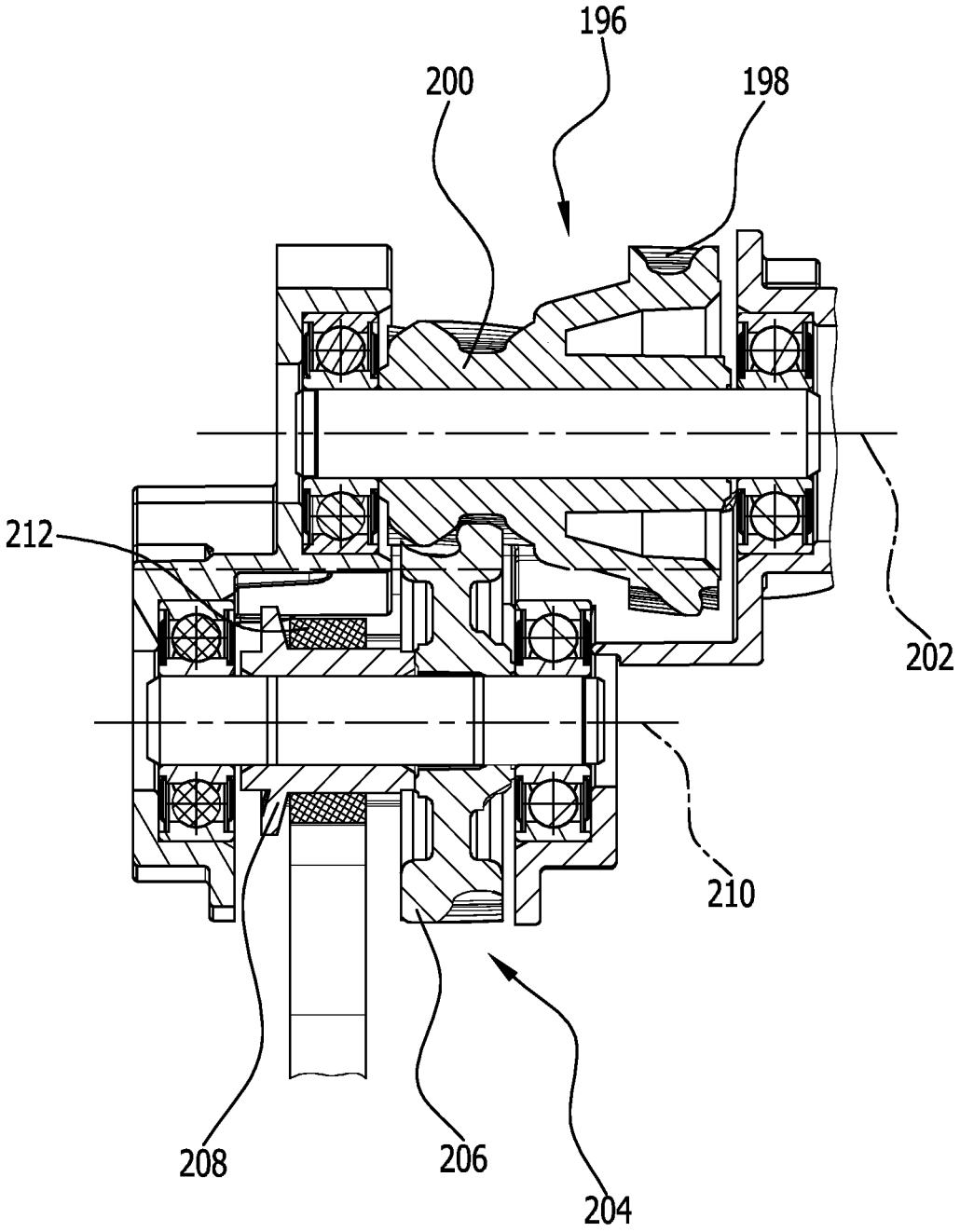
FIG. 18 is a sectional view along the plane designated 18-18 according to FIG. 16.

The pinion arrangement 188 has a first gearwheel-and-pinion combined unit 196 with a first gearwheel 198 and a first pinion 200. The first pinion 200 is coupled to the first gearwheel 198 such that it cannot rotate in relation thereto. The first gearwheel-and-pinion combined unit 196 is rotatable about a first axis of rotation 202 (FIG. 18). The first axis of rotation 202, about which the gearwheel-and-pinion combined unit 196 is mounted to rotate, is parallel to the axis of rotation 178 of the motor shaft 174. The first gearwheel 198 is coupled to the drive gearwheel 176 in a manner applying torque; the drive gearwheel 176 drives the first gearwheel-and-pinion combined unit 196.

The pinion arrangement 188 comprises a second gearwheel-and-pinion combined unit 204 with a second gearwheel 206 and a first pinion 208. The second pinion 208 is coupled to the second gearwheel 206 such that it cannot rotate in relation thereto.

The second gearwheel-and-pinion combined unit 204 is mounted to rotate about a second axis of rotation 210. The second axis of rotation 210 is parallel to the first axis of rotation 202.

The second gearwheel 206 is coupled to the first pinion 200 in a manner applying torque.

As a result of coupling the drive gearwheel 176, which has a smaller diameter than the first gearwheel 198, a first step-down stage is formed.

In one exemplary embodiment, the step-down ratio of this first stage is 11:34.

The first pinion 200 has a smaller diameter than the second gearwheel 206. This forms a second step-down stage.

In one exemplary embodiment, the step-down ratio at the second step-down stage is 14:29.

The first part 192 of the belt arrangement 190 comprises a first belt 212. This first belt 212 is coupled, in a manner applying torque, to the first shaft 56 by way of a first belt wheel 214 that is connected to the first shaft 56 such that it cannot rotate in relation thereto.

In one embodiment, the belt arrangement 190 comprises a first deflection element 216 on which the first belt 212 is guided.

By way of the first belt 212, it is possible to achieve a torque-applying coupling between the pinion arrangement 188 and the first shaft 56, which is at a spacing in the longitudinal direction 72 of the cleaning head 52.

The second pinion 208 has a smaller diameter than the first belt wheel 214. This forms a further step-down stage.

In one exemplary embodiment, the step-down ratio of this third step-down stage is 15:30.

The pinion arrangement 188 has a third gearwheel-and-pinion combined unit 218 with a third gearwheel 220 and a third pinion 222 (FIG. 7). The third gearwheel-and-pinion combined unit 218 is mounted to rotate about a third axis of rotation 224. The third axis of rotation 224 is parallel to the first axis of rotation 202.

The third gearwheel 220 takes the same form as the second gearwheel 206 and is coupled to the second gearwheel 206. Rotation of the third gearwheel-and-pinion combined unit 218 is in the opposite direction to rotation of the second gearwheel-and-pinion combined unit 204.

The third pinion 222 takes the same form as the second pinion 208.

The second part 194 of the belt arrangement 190 is coupled to the third gearwheel-and-pinion combined unit 218 in a manner applying torque.

It has a second belt 226 that is seated on the third pinion 222 and is guided to a second belt wheel 228 that is seated on the second shaft 62 such that it cannot rotate in relation thereto. The second belt 226 is deflected over a second deflection element 230.

The second part 194 of the belt arrangement 190 functions in the same way as the first part 192.

Stepping down of the speed is the same as in the case of the second gearwheel-and-pinion combined unit 204 with the first part 192 of the belt arrangement 190. The second gearwheel-and-pinion combined unit 204 is driven by way of the first gearwheel-and-pinion combined unit 196, wherein the second gearwheel-and-pinion combined unit 204 is in turn coupled directly to the third gearwheel-and-pinion combined unit 218, which it drives.

The overall step-down ratio of the gear device 180, which has multiple step-down stages, is in particular in the range between 1:10 and 1:15, and is for example approximately 1:12.5, wherein an appropriately high speed of the motor shaft 174 is stepped down to a speed of approximately 500 revolutions per minute at the cleaning roller units 60, 66.

A respective centre drive is provided for the shafts 56, 62.

The respective first belt wheel 214 and second belt wheel 228 lie centrally between external end faces 232*a*, 232*b* of the respective shaft 56, 62. Each shaft 56, 62 then has a first receiving region 234 and a second receiving region 236. Positioned between these is the respective belt wheel 214, 228. A cleaning medium such as a textile facing is positioned around the first receiving region 234 and the second receiving region 236. There is no cleaning medium 70 in the region of the respective belt wheel 214, 228.

As a result of a centre drive of this kind, the corresponding cleaning roller unit 60, 66 is formed in two parts.

A two-part form of this kind with a centre drive makes it possible to clean close to edges.

The drive motor 172 of the drive device 170 is seated in a housing 238 (FIG. 14). The gear device 180 is seated in a gear housing 240. In particular, the gear housing is connected to the housing 238 for the drive motor 172, or a common housing is formed.

The joint device 96 is seated above the housing 238, on the cleaning head 52.

In one embodiment, a free space 242 is associated with the drive device 170, in particular here at the combined unit comprising the housing 238 and the gear housing 240. This free space 242 is in particular delimited by a region, in particular a step-shaped region 244, at the combined unit comprising the housing 238 and the gear housing 240.

The region 244 and the free space 242 lie at least approximately centrally on the cleaning head 5, in particular relative to the width direction 78 of the cleaning head 52.

Arranged in the free space 242 and in the region 244 is in particular the gear device 96, or the recess 112 is located in this region 244 or in the free space 242. This gives a space-saving construction with optimised utilisation of space. This allows the height H to be kept small.

In particular, the first pivot axis 104 is located in the free space 242.

In order to maintain a compact structure of the cleaning head 52, it is provided here for the drive axis 178 and the first pivot axis 104 to lie as close to one another as possible and in particular to be at a spacing of at most 5 cm and preferably at most 3 cm.

Here, it is provided in particular for the joint device 96 with the first joint 102 and the second joint 106 to be seated centrally on the cleaning head 52, relative to the width direction 78. In relation to the longitudinal direction 72 between the front end 74 and the rear end 76, the joint device 96 preferably lies centrally or close to the centre, with a slight offset in the direction of the rear end 76, that is to say in the longitudinal direction 72 the joint device 96 lies closer to the rear end 76 than to the front end 74, wherein the joint device 96 lies closer to the centre in the longitudinal direction 72 than to the rear end 76 or to the front end 74.

The surface cleaning machine 10 functions as follows:

During operation, a user holds the holding rod device 100 by way of a handle. The cleaning head 52 is set with its cleaning roller units 60, 64 on the surface 18 to be cleaned. The user also stands on this. The surface cleaning machine 50 is manually guided.

A user can adjust the size by way of pivoting the holding rod device 100 about the first pivot axis 104.

During the cleaning procedure, because of the pivotability of the holding rod device 100 on the cleaning head 52 about the first pivot axis 104 and about the second pivot axis 108, the user can carry out a cleaning procedure comfortably.

In particular, by steering the holding rod device 100, the user can steer the cleaning head 52 on the surface 18 to be cleaned.

During the cleaning operation of the surface cleaning machine 50, the first cleaning roller unit 60 and the second cleaning roller unit 66 are driven in a rotary movement by the drive device 170. In particular, they are driven in opposite directions.

As a result of a wetting device, there is provision for wetting of the cleaning roller units 60, 66 with cleaning liquid (clean water or a mixture of clean water and cleaning agent). As a result, dirt is drawn off in an improved fashion.

A moistened facing (a moistened cleaning medium 70) of the cleaning roller units 60, 66 acts on dirt on the surface 18 that is to be cleaned. This dirt is drawn off and entrained by the cleaning roller units 60, 66 and discharged into the reservoir device 86 for dirty fluid. This may where necessary also be performed or supported by way of a suction flow by a suction assembly.

The holding rod device 100 can be put into the first position 140. This is a type of stowing position. In the first position 140, the position of the holding rod device 100 is secured by the fixing device 152.

In the second position 142 of the holding rod device 100, the surface cleaning machine 50 has a minimal height in the height direction 94. In this way, the surface cleaning machine 50 can for example be stored in a space-saving manner outside of a cleaning operation.

Further, in the second position 142 of the holding rod device 100, the surface cleaning machine 50 has a minimal height even during the cleaning operation, and this gives an optimum capacity for reaching under furniture and similar.

The drive device 170 takes a space-saving form and is arranged on the cleaning head 52 in space-saving manner. As a result of a multiple-stage step-down gear of the gear device 180, the drive motor 172 can take a form with small geometric dimensions and thus the height H of the cleaning head 52 may in turn be kept small.

This produces optimised edge cleaning in respect of the lateral sides 80, 82, but also in respect of the front end 74 and the rear end 76.

Moreover, as a result of this arrangement of the drive device 170, the surface cleaning machine 50 has a low centre of gravity. This results in optimised operability, with a low risk of tipping over.

As a result of providing spaced cleaning roller units 60, 66, there is no need to provide additional drive rollers or support rollers, and as a result corresponding tracks are not produced on a surface 18 to be cleaned, that is to say the appearance of the wiped area is not impaired.

The result is optimised operability at the same time as an optimised cleaning function of the surface cleaning machine.

The described arrangement and form of the drive device 170 can also be achieved on a cleaning head 246 (indicated in dashed lines in FIG. 14) on which no holding rod device 100 is arranged. A cleaning head 246 of this kind takes the form for example of a self-propelling and self-guiding device ("cleaning robot").

In that case, there is no need to provide a corresponding joint device either.

A cleaning head 246 of this kind—in particular taking the form of a self-propelling and self-guiding device—has the advantages described above, with a low height (corresponding to the height H). This in particular results in an optimised capacity for reaching under furniture and similar. It results in cleaning close to edges both to front and rear and also to both sides.

With a corresponding cleaning head 246, it is possible for example to provide a steering roller 248 or similar in order to enable appropriate steering, in the absence of guidance by a user, on the surface 18 to be cleaned.

Otherwise, the cleaning head 246 functions as a device as described above.

LIST OF REFERENCE NUMERALS

10 Cleaning machine
12 Cleaning head
14 Cleaning tool
16*a* First cleaning roller unit
16*b* Second cleaning roller unit
18 Surface to be cleaned
20 Holding rod device
21 User
22 Handle
24 Joint device
26 First joint
28 First pivot axis
30 Straight-ahead direction of travel
32 Straight-back direction of travel
34 First position
36 Second position
38 Second joint
40 Second pivot axis
42 Wetting device
44 Reservoir device for clean water
46 Reservoir device for dirty fluid
50 Surface cleaning machine
52 Cleaning head
54 Head body
56 First shaft
58 First axis of rotation
60 First cleaning roller unit
62 Second shaft
64 Second axis of rotation
66 Second cleaning roller unit
68 Bushing
70 Cleaning medium
72 Longitudinal direction
74 Front end
76 Rear end
78 Width direction
80 First lateral side
82 Second lateral side
84 Cover element
86 Reservoir device for dirty fluid
88 Underside
90 Upper side
92 Enveloping plane
94 Height direction
96 Joint device
98 Surface
100 Holding rod device
102 First joint
104 First pivot axis
106 Second joint
108 Second pivot axis
110 Enveloping plane
112 Recess
114 Opening
116 Pin element
118 Shaft
120, 120', 120" Connection element
122 Underside
124 Angled element
126, 126', 126" First region
127" Transverse web
128, 128', 128" Second region
129 Transverse direction
130, 130', 130" Obtuse angle
131 Osculating curve
132 Jaw-like opening
134 Pin element
136 Opening
138 Securing element
140 First position
142 Second position
144 Home position
146 Longitudinal axis
148 Right angle
150 Obtuse angle
152 Fixing device
154 Magnet
156 Magnet system
158 Flat iron pole
160 Acute angle
162 Region
164 Underside
166 Casing
168 Bellows
170 Drive device
172 Drive motor
174 Motor shaft
176 Drive gearwheel
178 Axis of rotation (drive axis)
180 Gear device
182 First direction of rotation

184 Second direction of rotation
186 Region
188 Pinion arrangement
190 Belt arrangement
192 First part
194 Second part
196 First gearwheel-and-pinion combined unit
198 First gearwheel
200 First pinion
202 First axis of rotation
204 Second gearwheel-and-pinion combined unit
206 Second gearwheel
208 Second pinion
210 Second axis of rotation
212 First belt
214 First belt wheel
216 First deflection element
218 Third gearwheel-and-pinion combined unit
220 Third gearwheel
222 Third pinion
224 Third axis of rotation
226 Second belt
228 Second belt wheel
230 Second deflection element
232*a* End face
232*b* End face
234 First receiving region
236 Second receiving region
238 Housing
240 Gear housing
242 Free space
244 Region
246 Cleaning head
248 Steering roller

The invention claimed is:

1. A cleaning machine, comprising a cleaning head;

a drive motor for rotary driving at least one cleaning roller and being arranged on the cleaning head;

a holding rod device; and a joint device with which the holding rod device is articulated to pivot on the cleaning head;

wherein arranged on the holding rod device is a connection element that articulates the holding rod device to the cleaning head and that has a first region and a second region;

wherein the first region and the second region are connected in one piece to one another and the connection element takes the form of an angled element;

wherein the second region is at a spacing from the first region in a transverse direction and the transverse direction is oriented transversely to a longitudinal axis of the holding rod device;

wherein the connection element is connected by way of the second region to a joint of the joint device with which a pivot axis is associated;

wherein the joint is a first joint of the joint device with a first pivot axis and the second region is directly connected to a shaft of the first joint;

wherein the connection element is connected by way of the first region to the holding rod device at an underside of the holding rod device;

wherein there is arranged or formed in the cleaning head a recess in which the joint is positioned, with the second region penetrating into the recess, at least with a part of the second region, and the shaft being seated in the recess;

wherein the first pivot axis lies within the cleaning head between an underside of the cleaning head and an upper side of the cleaning head and in or below the recess;

wherein the holding rod device is pivotal about the first pivot axis between a first position and a second position and in relation to a longitudinal axis of the holding rod device, the first region of the connection element is oriented at least approximately parallel to an enveloping plane at the upper side of the cleaning head;

wherein in the second position the cleaning machine has its minimal height H in a height direction between the underside of the cleaning head and the upper side of the cleaning head, further comprising a first roller unit, a second roller unit, and a drive device for driving the first roller unit and the second roller unit in rotation, wherein the drive device has the drive motor that, in relation to a longitudinal direction of the cleaning head, is positioned between the first roller unit and the second roller unit, wherein the drive device comprises a gear device through which torque of the drive motor is transmissible to the first roller unit and the second roller unit, and wherein the gear device comprises a step-down gear, wherein a speed of rotation of the first roller unit and a speed of rotation of the second roller unit are less than a motor speed of the drive motor;

wherein the gear device has a pinion arrangement, which acts as a two-stage step-down gear, and a belt arrangement, which acts as a one-stage step-down gear, wherein the belt arrangement is coupled to the pinion arrangement in a manner applying torque; and wherein the pinion arrangement has a first gearwheel-and-pinion combined unit coupled to the drive motor, and a second gearwheel-and-pinion combined unit coupled to the first gearwheel-and-pinion combined unit and to the belt arrangement.

2. The cleaning machine according to claim 1, wherein the second region is arranged at an angle to the first region, or wherein a transverse web is arranged between the first region and the second region.

3. The cleaning machine according to claim 1, wherein the first region is oriented coaxially relative to the longitudinal axis of the holding rod device.

4. The cleaning machine according to claim 1, wherein there is arranged on the cleaning head at least one cleaning tool, having at least one of the following:

the pivot axis of the joint is oriented at least approximately parallel to a planar surface on which the cleaning head is supported by the at least one cleaning tool, for a correct cleaning operation;

the pivot axis is oriented at least approximately parallel to an enveloping plane of the at least one cleaning tool, in respect of contact with a surface to be cleaned;

the pivot axis is oriented at least approximately parallel to an axis of rotation of the at least one cleaning tool;

the pivot axis is oriented at least approximately parallel to a width direction of the cleaning head between a first lateral side and a second lateral side;

the pivot axis is oriented transversely to a straight-ahead direction of travel of the cleaning head during a correct cleaning operation;

the cleaning head has a front end and a rear end, wherein it extends in a longitudinal direction between the front end and the rear end, and the pivot axis lies transversely to the longitudinal direction of the cleaning head;

at least one of the joint and the pivot axis lies between the front end and the rear end of the cleaning head, and lie at a centre between the front end and the rear end or closer to the centre than to the front end and to the rear end;

at least one of the joint and the pivot axis lies, relative to the longitudinal direction of the cleaning head, closer to the rear end than to the front end.

5. The cleaning machine according to claim 1, wherein the connection element has a jaw-like opening that faces a rear end of the cleaning head.

6. The cleaning machine according to claim 1, wherein, in relation to the pivot axis, the holding rod device has the first position with at least one of the following:

the holding rod device is positioned, in relation to a longitudinal direction of the holding rod device, transversely to the cleaning head;

the first region of the connection element is positioned transversely to the cleaning head;

the cleaning machine has its greatest height in the height direction between the underside of the cleaning head and the upper side of the cleaning head;

the second region of the connection element is positioned transversely to the cleaning head;

the second region of the connection element is oriented at an obtuse angle to the cleaning head, relative to a jaw-like opening of the connection element between the first region and the second region;

the obtuse angle of the orientation of the second region to the cleaning head corresponds to the difference between 270° and an obtuse angle between the first region and the second region.

7. The cleaning machine according to claim 6, wherein a fixing device for the purpose of fixing the first position with force locking is provided.

8. The cleaning machine according to claim 7, wherein the fixing device takes a form such that, if the cleaning head is set on a subsurface that is inclined by 10° to the horizontal in relation to the direction of gravity, the first position is maintained.

9. The cleaning machine according to claim 7, wherein the fixing device has a magnet device.

10. The cleaning machine according to claim 1, wherein a fixing device has a first element, which is arranged or formed on the cleaning head, and a second element, which is arranged or formed on the connection element, wherein the first element and the second element cooperate for the purpose of the force-locking fixing in the first position.

11. The cleaning machine according to claim 10, wherein the second element is arranged or formed on the second region of the connection element.

12. The cleaning machine according to claim 10, wherein the first element is a magnet or comprises a magnet that is arranged on the cleaning head, and the second element is a retaining element for the magnet.

13. The cleaning machine according to claim 12, wherein the magnet is part of a sandwich-type magnet system.

14. The cleaning machine according to claim 1, wherein at least one cleaning tool is arranged on the cleaning head, wherein the holding rod device has, relative to the pivot axis, the second position, and having at least one of the following:

in relation to the longitudinal axis of the holding rod device, the holding rod device is oriented at least approximately parallel to an enveloping plane of the cleaning head;

a region of the holding rod device faces the at least one cleaning tool;

in relation to a jaw-like opening of the connection element between the first region and the second region, the second region of the connection element is oriented at an angle of zero or an acute angle to the cleaning head;

the acute angle of the orientation of the second region to the cleaning head corresponds to a difference between 180° and an obtuse angle between the first region and the second region of the connection element;

the holding rod device does not project, or projects by at most 5 cm, above an upper side of the cleaning head.

15. The cleaning machine according to claim 1, wherein the joint device is arranged and takes a form such that, by steering the holding rod device, the cleaning head is steered on a surface that is to be cleaned.

16. The cleaning machine according to claim 1, wherein the joint device has the joint, as the first joint having a first pivot axis, and has a second joint having a second pivot axis, wherein the second pivot axis is oriented transversely to the first pivot axis.

17. The cleaning machine according to claim 16, wherein the second pivot axis intersects the first pivot axis or is at a spacing of at most 2 cm.

18. The cleaning machine according to claim 16, wherein the second pivot axis passes through the second region of the connection element.

19. The cleaning machine according to claim 16, wherein a joint element of the second joint is arranged at the second region of the connection element and enables pivotability about the second pivot axis.

20. The cleaning machine according to claim 1, wherein at least one of the following is provided:

in relation to a longitudinal axis of the cleaning head, the joint device is positioned between a first cleaning tool and a second cleaning tool;

in relation to a height direction of the cleaning head, between the underside of the cleaning head and the upper side of the cleaning head, the joint device is positioned above a reservoir device for dirty fluid;

in relation to the height direction of the cleaning head, between the underside of the cleaning head and the upper side of the cleaning head, the joint device is positioned above a drive device;

associated with the drive device is a free space in which the joint device is at least in part positioned.

21. The cleaning machine according to claim 1, wherein associated with the joint device is a casing.

22. The cleaning machine according to claim 1, wherein the step-down gear has a step-down ratio, of speed of the drive motor to roller speed, in the range between 1:10 and 1:15.

23. The cleaning machine according to claim 1, wherein the gear device takes a form such that the first roller unit and the second roller unit rotate in opposite directions.

24. The cleaning machine according to claim 1, wherein the step-down gear is formed to have multiple stages.

25. The cleaning machine according to claim 1, wherein the belt arrangement is coupled to a respective shaft of each roller unit in a manner applying torque.

26. The cleaning machine according to claim 1, wherein the pinion arrangement has a third pinion-and-gearwheel combined unit coupled to the second pinion-and-gearwheel combined unit and to the belt arrangement.

27. The cleaning machine according to claim 26, wherein the second pinion-and-gearwheel combined unit is coupled to a first part of the belt arrangement, which is coupled to the first roller unit, and wherein the third pinion-and-gearwheel combined unit is coupled to a second part of the belt arrangement, which is coupled to the second roller unit.

28. The cleaning machine according to claim 1, wherein at least one of the following is provided:

a drive axis of the drive motor is oriented parallel to the axis of rotation of the roller units;

the drive axis of the drive motor is oriented parallel to the pivot axis of the joint device;

the drive axis of the drive motor and the pivot axis are at a spacing of at most 5 cm from one another.

29. The cleaning machine according to claim 1, wherein arranged on the cleaning head are the first roller unit and the second roller unit that are each formed in two parts, wherein the drive device is coupled centrally to the respective roller units in a manner applying torque.

30. The cleaning machine according to claim 29, wherein the roller units reach as far as an end face of the cleaning head.

31. The cleaning machine according to claim 1, wherein the first roller unit and the second roller unit are provided, wherein at least one of the first roller unit and the second roller unit take the form of cleaning rollers.

32. The cleaning machine according to claim 1, wherein, in the height direction between the underside of the cleaning head and the upper side of the cleaning head, the cleaning head has a height of at most 20 cm.

33. The cleaning machine according to claim 1, wherein said cleaning machine takes the form of a self-propelling and self-steering device.

34. The cleaning machine according to claim 1, wherein said cleaning machine takes the form of a manually guided surface cleaning machine.

35. A cleaning head;

a holding rod device;

A cleaning machine, comprising a joint device with which the holding rod device is articulated to pivot on the cleaning head;

wherein arranged on the holding rod device is a connection element that has a first region and a second region;

wherein the second region is at a spacing from the first region in a transverse direction and the transverse direction is oriented transversely to a longitudinal axis of the holding rod device;

wherein the connection element is connected by way of the second region to a joint of the joint device with which a pivot axis is associated; and wherein the connection element is connected by way of the first region to the holding rod device;

a first roller unit;

a second roller unit; and a drive device for driving the first roller unit and the second roller unit in rotation, wherein the drive device has a drive motor that, in relation to a longitudinal direction of the cleaning head, is positioned between the first roller unit and the second roller unit;

wherein the drive device comprises a gear device through which torque of the drive motor is transmissible to the first roller unit and the second roller unit, and wherein the gear device comprises a step-down gear, wherein a speed of rotation of the first roller unit and a speed of rotation of the second roller unit are less than a motor speed of the drive motor;

wherein the gear device has a pinion arrangement, which acts as a two-stage step-down gear, and a belt arrangement, which acts as a one-stage step-down gear, wherein the belt arrangement is coupled to the pinion arrangement in a manner applying torque; and wherein the pinion arrangement has a first gearwheel-and-pinion combined unit coupled to the drive motor, and a second gearwheel-and-pinion combined unit coupled to the first gearwheel-and-pinion combined unit and to the belt arrangement.

* * * * *